US006360556B1

(12) United States Patent
Gagliano

(10) Patent No.: US 6,360,556 B1
(45) Date of Patent: Mar. 26, 2002

(54) APPARATUS AND METHOD FOR CONTROLLING FLUID DELIVERY TEMPERATURE IN A DISPENSING APPARATUS

(75) Inventor: Thomas Gagliano, Huntington Beach, CA (US)

(73) Assignee: SHURflo Pump Manufacturing Company, Inc., Santa Ana, CA (US)

( * ) Notice: Subject to any disclaimer, the term of this patent is extended or adjusted under 35 U.S.C. 154(b) by 0 days.

(21) Appl. No.: 09/437,853

(22) Filed: Nov. 10, 1999

(51) Int. Cl.[7] ..... B67D 5/62
(52) U.S. Cl. ..... 62/396; 222/146.6
(58) Field of Search ..... 62/390, 393, 396, 62/389; 222/146.6

(56) References Cited

U.S. PATENT DOCUMENTS

| | | | |
|---|---|---|---|
| 2,018,543 | A | 10/1935 | Buirk |
| 2,144,628 | A | 1/1939 | Hothersall |
| 2,286,205 | A | 6/1942 | Grubb |
| 2,380,884 | A | 7/1945 | Von Stoeser et al. |
| 2,450,315 | A | 9/1948 | Vetrano |
| 2,451,682 | A | 10/1948 | Lund |
| 2,475,511 | A | 7/1949 | Nicholson |
| 2,531,315 | A | 11/1950 | Wyllie |
| 2,552,635 | A | 5/1951 | Kleist |
| 2,644,619 | A | 7/1953 | Brown |
| 2,729,950 | A | 1/1956 | Toothman |
| 2,763,130 | A | 9/1956 | Henderson |
| 2,893,444 | A | 7/1959 | Waddington et al. |
| 2,912,143 | A | 11/1959 | Woolfolk |
| 2,952,991 | A | 9/1960 | Pierre |
| 3,047,033 | A | 7/1962 | Rosen |
| 3,072,302 | A | 1/1963 | Giovannoni et al. |
| 3,211,350 | A | 10/1965 | Brown |
| 3,218,819 | A | 11/1965 | Crotser |
| 3,234,753 | A | 2/1966 | Quick |

(List continued on next page.)

FOREIGN PATENT DOCUMENTS

| | | |
|---|---|---|
| BE | 871075 | 6/1979 |
| BR | 8203069 | 10/1983 |
| DE | 2329182 | 1/1975 |
| DE | 3435725 | 4/1986 |

(List continued on next page.)

*Primary Examiner*—Henry Bennett
*Assistant Examiner*—Chen-Wen Jiang
(74) *Attorney, Agent, or Firm*—Michael Best & Friedrich LLP

(57) ABSTRACT

Preferred embodiments of the present invention have a nozzle assembly capable of controlling pressure of comestible fluid exiting the nozzle assembly, a refrigeration system in which refrigerant pressure and temperature is controllable to enable control of comestible fluid temperature, heat exchangers connected to cool comestible fluid in the nozzles, an ultraviolet sterilization system for sterilizing locations outside and inside the system, and a hand held comestible fluid dispenser capable of cooling and selectively dispensing one of several comestible fluids supplied thereto. To provide comestible fluid at rack pressure to the nozzles in one highly preferred embodiment, each nozzle preferably has a valve movable through a number of closed positions to change pressure within the nozzle. Prior to fluid dispense, pressure at the nozzle is preferably reduced by actuating the valve through its range of closed positions. To improve temperature control and cooling efficiency, the present invention preferably employs heat exchangers adjacent to the nozzle assemblies. Due to their locations close to the nozzle assemblies, the heat exchangers generate convective recirculation through the nozzle assemblies to cool comestible fluid to the discharge openings thereof. The present invention can take the form of a multi-fluid dispensing gun having such a nozzle and heat exchanger relationship and having the pressure controlling valve as described above. To further improve control of comestible fluid temperature, the present invention preferably has an evaporator pressure regulator to control refrigerant pressure upstream of the refrigeration system compressor and a hot gas bypass valve to control refrigerant temperature.

35 Claims, 7 Drawing Sheets

U.S. PATENT DOCUMENTS

| | | | |
|---|---|---|---|
| 3,252,654 | A | 5/1966 | Deutch |
| 3,307,751 | A | 3/1967 | Kraft |
| 3,378,129 | A | 4/1968 | Mencacci |
| 3,410,458 | A | 11/1968 | Johnston |
| 3,525,333 | A | 8/1970 | Mencacci |
| 3,566,774 | A | 3/1971 | Mencacci |
| 3,566,775 | A | 3/1971 | Mencacci |
| 3,602,004 | A | 8/1971 | Peavler |
| 3,656,528 | A | 4/1972 | Mencacci |
| 3,666,142 | A | 5/1972 | Gust |
| 3,666,177 | A | 5/1972 | Mencacci |
| 3,683,976 | A | 8/1972 | Remane |
| 3,695,314 | A | 10/1972 | Watts et al. |
| 3,700,386 | A | 10/1972 | Mencacci |
| 3,718,223 | A | 2/1973 | Meissner |
| 3,718,233 | A | 2/1973 | Nordhoff |
| 3,730,500 | A | 5/1973 | Richards |
| 3,735,898 | A | 5/1973 | Smith |
| 3,743,145 | A | 7/1973 | Johnston |
| 3,757,832 | A | 9/1973 | Waxlax |
| 3,777,937 | A | 12/1973 | Buck |
| 3,779,292 | A | 12/1973 | Mencacci |
| 3,782,609 | A | 1/1974 | Zucconi |
| 3,788,093 | A | 1/1974 | Lauterbach |
| 3,806,616 | A | 4/1974 | Mencacci et al. |
| 3,823,846 | A | 7/1974 | Probst |
| 3,830,405 | A | 8/1974 | Jaeger |
| 3,863,810 | A | 2/1975 | Hanson |
| 3,878,970 | A | 4/1975 | Nezworski |
| 3,881,636 | A | 5/1975 | D'Aubreby |
| 3,902,636 | A | 9/1975 | Zilk |
| 3,920,149 | A | 11/1975 | Fortino |
| 3,951,186 | A | 4/1976 | Mencacci |
| 3,978,900 | A | 9/1976 | Mencacci et al. |
| 3,985,267 | A | 10/1976 | Selvia et al. |
| 3,995,770 | A | 12/1976 | Schwitters |
| 4,003,302 | A | 1/1977 | Mencacci et al. |
| 4,006,840 | A | 2/1977 | Shannon |
| 4,016,705 | A | 4/1977 | Wilson et al. |
| 4,019,341 | A | 4/1977 | Iwasaki et al. |
| 4,033,093 | A | 7/1977 | Mencacci |
| 4,042,151 | A | 8/1977 | Uttech |
| 4,094,445 | A | 6/1978 | Bevan |
| 4,102,151 | A | 7/1978 | Kramer et al. |
| 4,121,507 | A | 10/1978 | Kuckens |
| 4,135,641 | A | 1/1979 | Fallon et al. |
| 4,164,590 | A | 8/1979 | Mencacci |
| 4,169,408 | A | 10/1979 | Mencacci |
| 4,174,872 | A | 11/1979 | Fessler |
| 4,179,986 | A | 12/1979 | Mencacci |
| 4,180,189 | A | 12/1979 | Zurit et al. |
| 4,202,387 | A | 5/1980 | Upton |
| 4,210,172 | A | 7/1980 | Fallon et al. |
| 4,273,151 | A | 6/1981 | Nezworski |
| 4,278,186 | A | 7/1981 | Williamson |
| 4,291,821 | A | 9/1981 | Nezworski |
| 4,313,313 | A | 2/1982 | Chrostowski |
| 4,333,504 | A | 6/1982 | Golding |
| 4,350,270 | A | 9/1982 | Nezworski |
| 4,350,273 | A | 9/1982 | Nezworski et al. |
| 4,360,128 | A | 11/1982 | Neumann |
| 4,444,336 | A | 4/1984 | Nielsen |
| 4,495,778 | A | 1/1985 | Shaw |
| 4,512,377 | A | 4/1985 | Greer |
| 4,520,953 | A | 6/1985 | Fallon |
| 4,564,126 | A | 1/1986 | Adolfsson |
| 4,590,975 | A | 5/1986 | Credle, Jr. |
| 4,595,131 | A | 6/1986 | Ruskin et al. |
| 4,602,485 | A | 7/1986 | Fujimoto et al. |
| 4,606,367 | A | 8/1986 | Britt |
| 4,633,672 | A | 1/1987 | Persem et al. |
| 4,641,763 | A | 2/1987 | Landers et al. |
| 4,644,855 | A | 2/1987 | Woolman et al. |
| 4,646,535 | A | 3/1987 | Matsuoka et al. |
| 4,658,988 | A | 4/1987 | Hassell |
| 4,675,660 | A | 6/1987 | Boscolo |
| 4,679,408 | A | 7/1987 | Nelson |
| 4,685,598 | A | 8/1987 | Nezworski |
| 4,687,120 | A | 8/1987 | McMillin |
| 4,691,842 | A | 9/1987 | Foures |
| 4,711,377 | A | 12/1987 | Brown |
| 4,715,414 | A | 12/1987 | Harrison et al. |
| 4,718,246 | A | 1/1988 | Mitchell |
| 4,720,076 | A | 1/1988 | Hyde |
| 4,728,010 | A | 3/1988 | Johnston |
| 4,730,463 | A | 3/1988 | Stanfill |
| 4,732,300 | A | 3/1988 | Valiyee et al. |
| 4,737,037 | A | 4/1988 | Mojonnier |
| 4,738,378 | A | 4/1988 | Oakley et al. |
| 4,744,395 | A | 5/1988 | Ziegler |
| 4,748,998 | A | 6/1988 | Färber et al. |
| 4,796,785 | A | 1/1989 | Merritt |
| 4,805,806 | A | 2/1989 | Smith |
| 4,805,906 | A | 2/1989 | Wiczer et al. |
| 4,808,346 | A | 2/1989 | Strenger |
| 4,856,678 | A | 8/1989 | Stanfill et al. |
| 4,869,396 | A | 9/1989 | Horino et al. |
| 4,890,774 | A | 1/1990 | Poore |
| 4,895,194 | A | 1/1990 | McCann et al. |
| 4,899,911 | A | 2/1990 | Rohde et al. |
| 4,923,078 | A | 5/1990 | Brown |
| 4,949,764 | A | 8/1990 | Clusserath et al. |
| 4,967,936 | A | 11/1990 | Bingler |
| 4,969,576 | A | 11/1990 | Merrill et al. |
| 4,976,295 | A | 12/1990 | Clusserath |
| 4,979,641 | A | 12/1990 | Turner |
| 4,986,449 | A | 1/1991 | Valiyee et al. |
| 5,000,352 | A | 3/1991 | Cleland |
| 5,042,692 | A | 8/1991 | Valiyee et al. |
| 5,050,806 | A | 9/1991 | Anderson et al. |
| 5,056,686 | A | 10/1991 | Jarrett |
| 5,064,097 | A | 11/1991 | Brog et al. |
| 5,104,003 | A | 4/1992 | Stecoza |
| 5,104,007 | A | 4/1992 | Utter |
| 5,110,012 | A | 5/1992 | Scholle et al. |
| 5,115,841 | A | 5/1992 | Horino et al. |
| 5,115,942 | A | 5/1992 | Merrill et al. |
| 5,118,009 | A | 6/1992 | Novitsky |
| 5,125,440 | A | 6/1992 | Mette |
| 5,129,548 | A | 7/1992 | Wisniewski |
| 5,139,169 | A | 8/1992 | Boyer |
| 5,150,743 | A | 9/1992 | Walusiak |
| 5,178,799 | A | 1/1993 | Brown et al. |
| 5,180,081 | A | 1/1993 | McCann |
| 5,184,942 | A | 2/1993 | Deininger et al. |
| 5,190,189 | A | 3/1993 | Zimmer et al. |
| 5,203,474 | A | 4/1993 | Haynes |
| 5,219,008 | A | 6/1993 | Shannon |
| 5,228,312 | A | 7/1993 | Williams |
| 5,228,486 | A | 7/1993 | Henninger |
| RE34,337 | E | 8/1993 | Bennett |
| 5,240,144 | A | 8/1993 | Feldman |
| 5,249,710 | A | 10/1993 | Hassell et al. |
| 5,255,819 | A | 10/1993 | Peckels |
| 5,268,849 | A | 12/1993 | Howlett et al. |
| 5,280,711 | A | 1/1994 | Motta et al. |
| D345,282 | S | 3/1994 | Henninger |
| 5,333,759 | A | 8/1994 | Deering |
| 5,335,819 | A | 8/1994 | Martin |

5,339,874 A 8/1994 Cragun
5,349,993 A 9/1994 Casey
5,353,958 A 10/1994 Hawkins
5,356,045 A 10/1994 Parks et al.
5,363,671 A 11/1994 Frosythe et al.
5,404,901 A 4/1995 Pickrell et al.
5,431,302 A 7/1995 Tulley et al.
5,433,348 A 7/1995 Deering et al.
5,445,290 A 8/1995 Forsythe et al.
5,450,882 A 9/1995 Cragun
5,476,193 A 12/1995 Haynes
5,487,493 A 1/1996 McNabb
5,524,452 A 6/1996 Hassell et al.
5,555,791 A 9/1996 McNeill et al.
5,564,601 A * 10/1996 Cleland et al. ..... 222/146.6 X
5,564,602 A * 10/1996 Cleland et al. ..... 222/146.6
5,566,732 A 10/1996 Nelson
5,573,145 A 11/1996 Groh
5,575,405 A 11/1996 Stratton et al.
5,603,363 A 2/1997 Nelson
5,603,430 A 2/1997 Loehrke et al.
5,617,736 A * 4/1997 Ito et al. ..... 62/393
5,630,441 A 5/1997 Feldman
D382,761 S 8/1997 Ford
5,657,911 A 8/1997 Mogler et al.
5,660,307 A 8/1997 Schreoder et al.
5,669,222 A 9/1997 Jaster et al.
5,722,567 A 3/1998 Jones et al.
5,732,856 A 3/1998 Fry
5,743,107 A * 4/1998 Kyees ..... 62/390
5,743,108 A * 4/1998 Cleland ..... 62/393
5,785,211 A 7/1998 Tieskoetter
5,791,523 A 8/1998 Oh
5,794,823 A 8/1998 Roundtree
5,813,574 A 9/1998 McNabb
5,829,646 A 11/1998 Schroeder et al.
5,836,483 A 11/1998 Disel
5,839,291 A 11/1998 Chang
5,842,617 A 12/1998 Younkle et al.
5,848,736 A 12/1998 Boumann
5,873,259 A * 2/1999 Spillman ..... 62/396
5,931,343 A 8/1999 Topar et al.
5,960,997 A 10/1999 Forsythe
5,967,367 A 10/1999 Orsborn
5,979,713 A 11/1999 Grill
6,019,257 A 1/2000 Rasmussen

FOREIGN PATENT DOCUMENTS

DE 3718426 12/1987
DE 3718893 12/1988
DE 4102875 8/1992
DE 29702989 5/1997
EP 0080571 6/1983
EP 0173031 3/1986
EP 0204899 12/1986
EP 0704899 12/1986
EP 0274370 7/1988
EP 0289213 11/1988
EP 0322729 7/1989
EP 0383495 8/1990
EP 0 861 801 A1 2/1998
EP 0861801 9/1998
EP 0867219 9/1998
ES 2134142 9/1999
GB 1261384 1/1972
GB 2000485 1/1979
GB 2170781 8/1986
GB 2236736 4/1991
GB 2283299 5/1995
GB 2307975 6/1997
JP 8230989 9/1996
JP 10194393 7/1998
JP 11171297 6/1999
WO 9947451 9/1999

* cited by examiner

APPARATUS AND METHOD FOR CONTROLLING FLUID DELIVERY TEMPERATURE IN A DISPENSING APPARATUS

FIELD OF THE INVENTION

This invention relates generally to fluid dispensers and more particularly, to comestible fluids dispensers and to cooling, sterilizing, measurement, and pressure control devices therefor.

BACKGROUND OF THE INVENTION

Despite significant advancements in fluid dispensing devices and systems, many problems that have existed for decades related to such devices and systems remain unsolved. These problems exist in many different fluid dispensing applications, but have a particularly significant impact upon fluid dispensing devices and systems in the food and beverage industry as will be described below. Comestible fluid dispensers in this industry can be found for dispensing a wide variety of carbonated and non-carbonated pre-mixed and post-mixed drinks, including for example beer, soda, water, coffee, tea, and the like. Fluid dispensers in this industry are also commonly used for dispensing non-drink fluids such as condiments, food ingredients, etc. The term "comestible fluid" as used herein and in the appended claims refers to any type of food or drink intended to be consumed and which is found in a flowable form.

A majority of the long-standing problems in the comestible fluid dispensing art are found in dispensing applications for carbonated beverages. First, because the fluid being poured is carbonated and is therefore sensitive to pressure drops, conventional carbonated comestible fluid dispensers are generally slow, requiring several seconds to fill even an average size cup or glass. Second, when flow speeds are increased, the dispensed beverage often has an undesirably large foam head (which can overflow, spill, or otherwise create a mess) and is often flat due to the fast dispense. Some existing devices use hydrostatic pressure to push comestible fluid out of a holding tank located above the dispensing nozzle. One such device is disclosed in U.S. Pat. No. 5,603,363 issued to Nelson. Unfortunately, these devices do not provide for pressure control at the nozzle, and (at least partly for this reason) are limited in their ability to prevent foaming and loss of carbonation in the case of carbonated comestible fluids. The working potential of rack pressure in such devices is largely wasted in favor of hydrostatic pressure. By not maintaining rack pressure to the nozzles in these devices, carbonated comestible fluid inevitably loses its carbonation over time while waiting for subsequent dispenses. Also, like other existing beer dispensers, such devices cool and/or keep the comestible fluid cool by the relatively inefficient practice of cooling a reservoir or supply of comestible fluid.

Another problem of conventional comestible fluid beverage dispensers is related to the temperature at which the fluid is kept prior to dispense and at which the fluid is served. Some beverages are typically served cold but without ice, and therefore must be cooled or refrigerated prior to dispense. This requirement presents significant design limitations upon dispensers for dispensing such beverages. By way of example only, beer is usually served cold and must therefore be refrigerated or cooled prior to dispense. Conventional practice is to cool the beer in a refrigerated and insulated storage area. The process of refrigerating a beer storage area sometimes for an indefinite period of time prior to beer dispense is fairly inefficient and expensive. Such refrigeration also does not provide for quick temperature control or temperature change of the comestible fluid to be dispensed. Specifically, because the comestible fluid in storage is typically found in relatively large quantities, quick temperature change and adjustment by a user is not possible. Also, conventional refrigeration systems are not well suited for responsive control of comestible fluid temperature by automatic or manual control of the refrigeration system.

Unlike numerous other comestible fluids which do not necessarily need to be cooled (e.g., soft drinks, tea, lemonade, etc., which can be mixed with ice in a vessel after dispense) or at least do not require a cooling device or system for fluid lines running between a refrigerated fluid source and a nozzle, tap, or dispensing gun, beer is ideally kept cool up to the point of dispense. Therefore, many conventional dispensers are not suitable for dispensing beer. For example, beer located within fluid lines between a refrigerated fluid source and a nozzle, tap, or dispensing gun can become warm between dispenses. Warm beer in such fluid lines must be served warm, be mixed with cold beer following the warm beer in the fluid lines, or be flushed and discarded. These options are unacceptable as they call either for product waste or for serving product in a state that is less than desirable. In addition, because many comestible fluids are relatively quickly perishable, holding such fluids uncooled (such as in fluid lines running from a refrigerated fluid source to a nozzle, tap, or dispensing gun) for a length of time can cause the fluid to spoil, even fouling part or all of the dispensing system and requiring system flushing and cleaning.

Because many comestible fluids should be kept cool up to the point of dispense, the apparatus or elements necessary to achieve such cooling have significantly restricted conventional dispenser designs. Therefore, dispensers for highly perishable fluids such as beer are therefore typically non-movable taps connected via insulated or refrigerated lines to a refrigerated fluid source, while dispensers for less perishable fluids (and especially those that can be cooled by ice after dispense) can be hand-held and movable, connected to a source of refrigerated or non-refrigerated fluid by an unrefrigerated and uninsulated fluid line if desired.

A comestible fluid dispenser design issue related to the above problems is the ability to clean and sterilize the dispenser as needed. Like the problems described above, improperly cleaned dispenser systems can affect comestible fluid taste and smell and can even cause fresh comestible fluid to turn bad. Many potential dispenser system designs cannot be used due to the inability to properly clean and sterilize one or more internal areas of the dispenser system. Particularly where dispenser system designs call for the use of small components or for components having internal areas that are small, difficult to access, or cannot readily be cleaned by flushing, the advantages such designs could offer are compromised by cleaning issues.

The problems described above all have a significant impact upon dispensed comestible fluid quality and taste, but also have an impact upon an important issue in most dispenser applications: speed. Whether due to the inability to use well known devices for increasing fluid flow, due to the fact that carbonated fluids demand particular care in their manner of dispense, or due to dispenser design restrictions resulting from perishable fluids, conventional comestible fluid dispensers are invariably slow and inefficient.

In light of the problems and limitations of the prior art described above, a need exists for a comestible fluid dispensing apparatus and method capable of rapidly dispensing comestible fluid in a controlled manner without foaming or de-carbonating the fluid even between extended periods between dispenses, which is capable of maintaining the comestible fluid throughout the dispensing apparatus cool indefinitely and with high efficiency, which permits quick and accurate temperature control of comestible fluid dispensed by automatic or manual refrigeration system control, which can be in the form of a mounted or hand-held apparatus, which can be easily cleaned and sterilized even though relatively small and difficult to access internal areas exist in the apparatus, and which is capable of monitoring apparatus operation and dispense parameters for controlling dispense pressure, flow speed, and head size. Each preferred embodiment of the present invention achieves one or more of these results.

SUMMARY OF THE INVENTION

The present invention addresses the problems of the prior art described above by providing a nozzle assembly capable of controlling pressure of comestible fluid exiting the nozzle assembly, a refrigeration system that employs refrigerant pressure control in the refrigeration system to provide efficient and superior control of comestible fluid temperature, heat exchangers of a type and connected in a manner to cool comestible fluid up to the exit ports of dispensing nozzles, a sterilization system for effectively sterilizing even hard to access locations outside and inside the comestible fluid dispensing system, and a hand held comestible fluid dispenser capable of cooling and selectively dispensing one of several warm comestible fluids supplied thereto.

The present invention solves the problem of how to employ comestible fluid rack pressure as a pressure for the entire dispensing system without the associated dispense problems such relatively high pressure can produce (particularly in carbonated beverage systems such as beer dispensing systems, where it is most desirable to keep carbonated fluid pressurized for an indefinite period of time between dispenses). In one embodiment of the present invention, nozzle assemblies from which comestible fluid is dispensed are provided with valves each having an open position and a range of closed positions corresponding to different comestible fluid pressures at the dispensing outlet of the nozzle. Control of the valve to enlarge a fluid holding chamber or reservoir in the nozzle assembly prior to opening results in a lower controllable dispense pressure. Preferably, the valve is a plunger valve in telescoping relationship with a housing of the nozzle. Alternative embodiments of the present invention employ other pressure reduction elements and devices to control dispense pressure at the nozzle. For example, a purge line can extend from the nozzle assembly or from the fluid line supplying comestible fluid to the nozzle assembly. By bleeding an amount of comestible fluid from the nozzle or from the fluid line prior to opening the nozzle, a system controller can reduce comestible fluid pressure in the nozzle to a desired and controllable dispense level. Other embodiments of the present invention control comestible fluid pressure at the nozzle by employing movable fluid line walls, deformable fluid chamber walls, etc. Flow information can be measured and monitored by the control system via the same pressure sensors and/or flowmeters used to control nozzle valve actuation, thereby permitting a user to monitor comestible fluid dispense and waste, if desired.

To improve temperature control and cooling efficiency of the dispensing system, the present invention preferably employs heat exchangers adjacent to the nozzle assemblies, with no substantial structural elements to block flow between each heat exchanger and its respective nozzle assembly. Highly efficient plate-type heat exchangers are preferably used for their relatively high efficiency and small size. A venting system or plug can be used to vent or fill any head space that may exist in the heat exchangers, thereby avoiding cleaning and pressurized dispensing problems. Due to their locations close to the nozzle assemblies, the heat exchangers generate convective recirculation through the nozzle assemblies to send cold comestible fluid to the terminal portion of the nozzle assembly and to receive warmer comestible fluid therefrom. Comestible fluid therefore remains cool up to the dispensing outlet of each nozzle assembly. Also, because the comestible fluid is cooled near the point of dispense, the inefficient practice of refrigerating the source of the comestible fluid for a potentially long time between dispenses by convective cooling in an insulated storage area can be eliminated in many applications.

The present invention can take the form of a dispensing gun if desired, thereby providing for dispensing nozzle mobility and dispense speed. Preferred embodiments of the dispensing gun have a heat exchanger located adjacent to a nozzle assembly to generate cooling convective recirculation in the nozzle assembly as discussed above. To increase portability and a user's ability to manipulate the dispensing gun, the heat exchanger is a highly efficient heat exchanger such as a plate-type heat exchanger. The dispensing gun can have multiple comestible fluid input lines, thereby permitting a user to selectively dispense any of the multiple comestible fluids. Preferably, a valve is located between the heat exchanger and the nozzle assembly of the dispensing gun and can be controlled by a user via controls on the dispensing gun to dispense any of the fluids supplied thereto. Like the nozzle assemblies and heat exchangers mentioned above, the location of a heat exchanger near the point of dispense removes the requirement of refrigerating the comestible fluid supply in many applications. Also, pressure control at the nozzle is preferably provided by a nozzle assembly valve having a range of closed positions as mentioned above.

To further improve control of comestible fluid temperature, the present invention preferably has a refrigeration system that is controllable by controlling refrigerant temperature and/or pressure. Specifically, an evaporator pressure regulator can be used to control refrigerant pressure upstream of the compressor in the refrigeration system, thereby controlling the cooling ability of refrigerant in the heat exchanger and controlling the temperature of the refrigerant passing through the heat exchanger. In addition or alternatively, a hot gas bypass valve can bleed hot refrigerant from the compressor for reintroduction into cold refrigerant upstream of the heat exchanger, thereby also controlling the cooling ability of refrigerant in the heat exchanger and controlling the temperature of comestible fluid passing through the heat exchanger, particularly in the event of a low or zero-load operational condition in the refrigeration system (e.g., between infrequent dispenses when fluid in the heat exchanger is already cold).

Preferred embodiments of the present invention have an ultraviolet light assembly for sterilizing external and internal surfaces of the system. The ultraviolet light assembly has an ultraviolet light generator and has one or more ultraviolet light transmitters for transmitting the ultraviolet light to various locations in and on the dispensing system. For example, ultraviolet light can be transmitted to the nozzle exterior surfaces frequently immersed in sub-surface filling operations, head spaces in the heat exchangers, and even to locations within fluid lines of the dispensing system. The ultraviolet light transmitters can be fiber optic lines, light pipes, or other conventional (and preferably flexible) members capable of transmitting the ultraviolet light a distance from the ultraviolet light generator to the locations to be sterilized.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
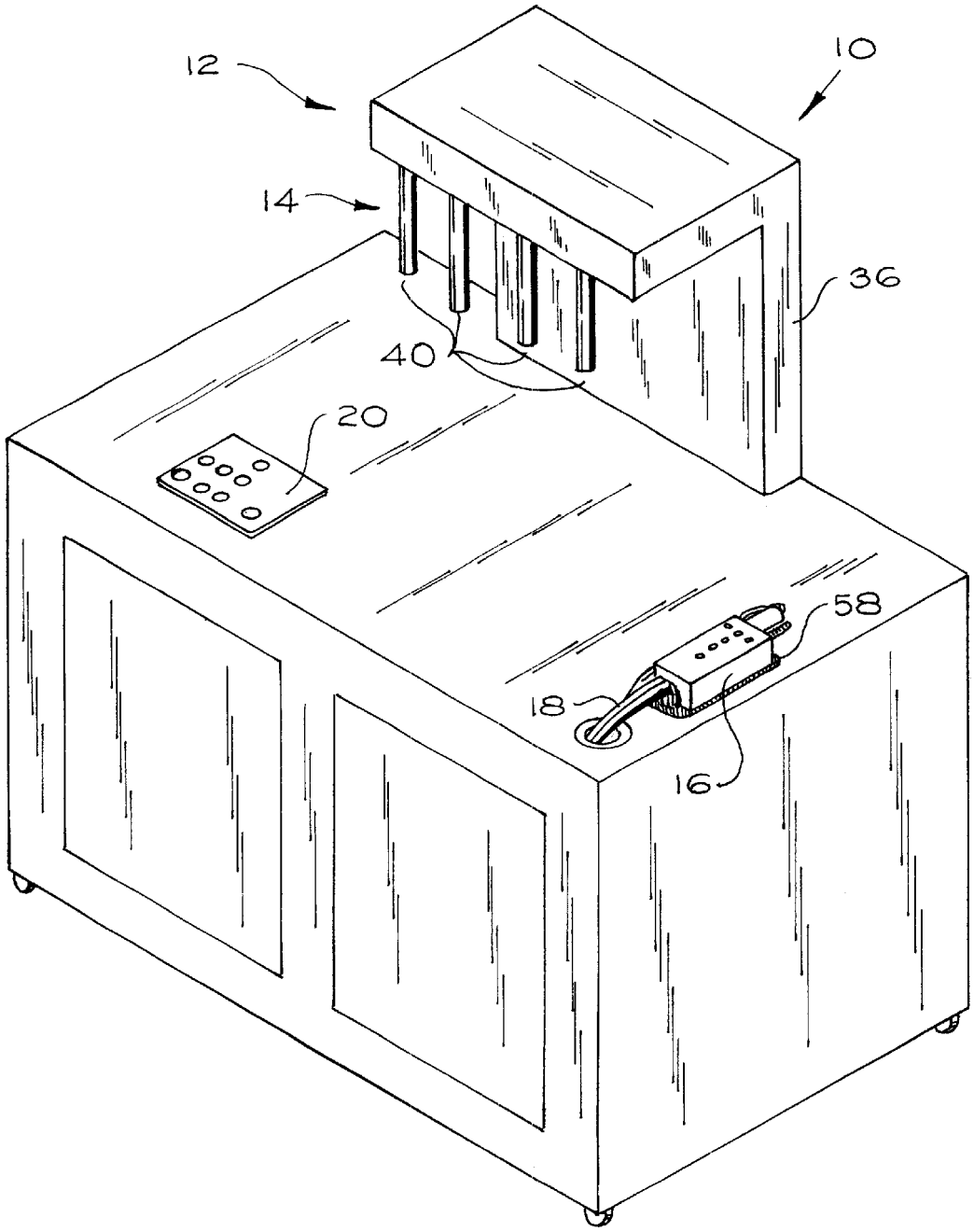
FIG. 1 is a perspective view of a vending cart having a set of rack nozzle assemblies, a dispensing gun, and associated elements according to a first preferred embodiment of the present invention.

The present invention finds application in virtually any environment in which comestible fluid is dispensed. By way of example only, the figures of the present application illustrate the present invention employed in a mobile vending stand (indicated generally at 10). With reference first to FIG. 1, the vending stand 10 is preferably a self-contained unit, and can be powered by a generator or by a power source via an electrical cord (not shown). The vending stand shown has a dispensing rack 12 from which extend a number of dispensing nozzles 14 for dispense of different comestible fluids. Also, the illustrated vending stand 10 has a comestible fluid dispensing gun 16 capable of selectively dispensing one of multiple comestible fluids supplied thereto by fluid hoses 18. For user control of stand and dispensing operations, the vending stand 10 preferably has controls 20 (most preferably in the form of a control panel as shown) in a user-accessible location.

Figure 2:
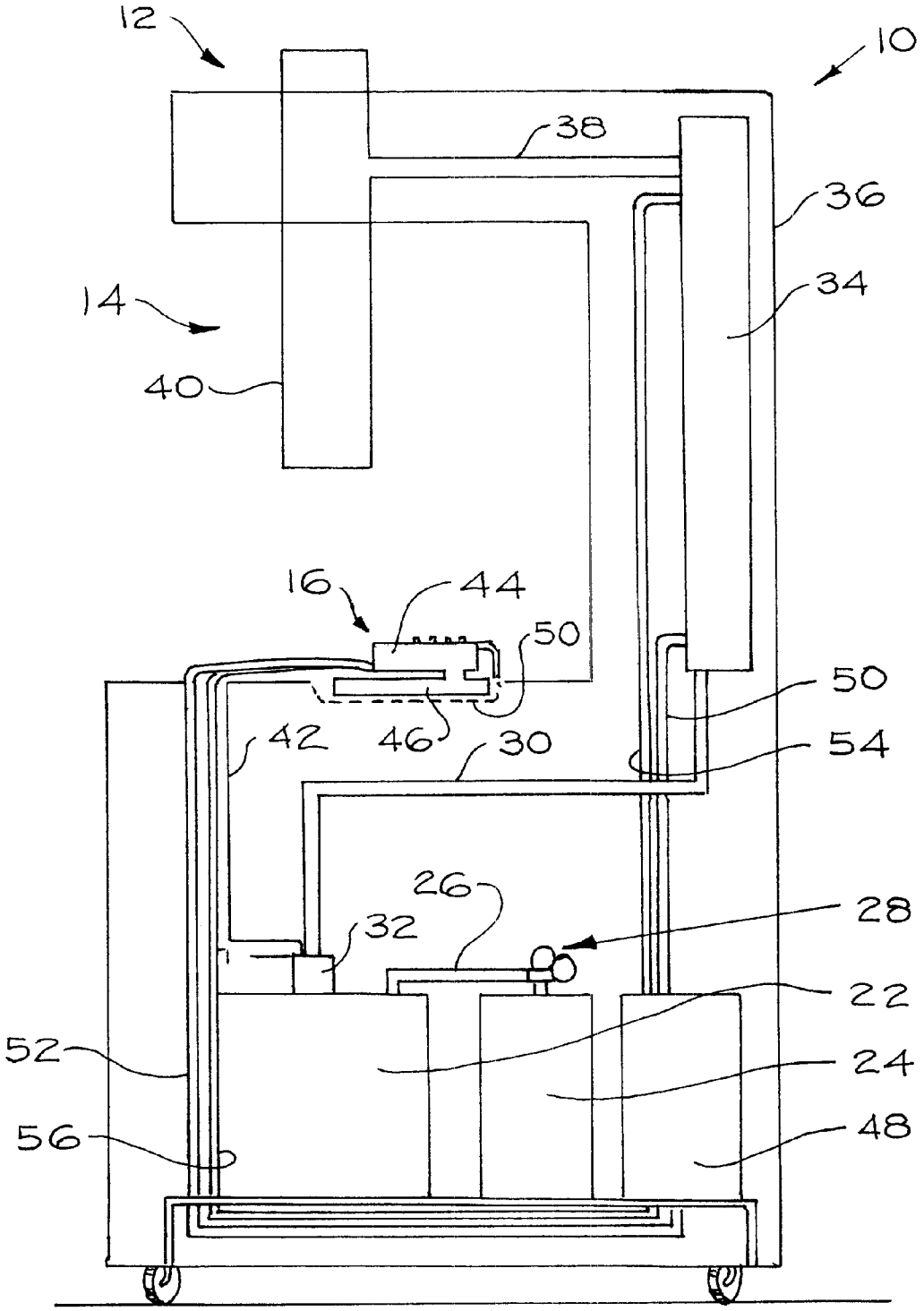
FIG. 2 is an elevational cross section view in of the vending cart shown in FIG. 1, showing connections and elements located within the vending cart.

As shown in FIG. 2, the vending stand 10 houses a supply of beers preferably in the form of kegs 22. The following description is with reference to only one keg 22 and associated pressurizing and fluid delivery elements (such as fluid lines, pressure regulators, nozzles, and other dispensing equipment), but applies to the other kegs 22 and their associated dispensing equipment that are not visible in the view of FIG. 2. Also, the following description of the invention is presented only by way of example with reference to different embodiments of an apparatus for dispensing beer. It should be noted, however, that the present invention is not defined by the type of comestible fluid being dispensed or the vessel in which such fluid is stored or dispensed from. The present invention can be used to dispense virtually any other type of comestible fluid as noted in the Background of the Invention above. Other comestible fluids often not found in kegs, but are commonly transported and stored in many other types of fluid vessels. The present invention is equally applicable and encompasses dispensing operations of such other comestible fluids in different fluid vessels.

As is well known to those skilled in the art, beer is stored pressurized, and is dispensed from conventional kegs by a pressure source or fluid pressurizing device such as a tank of carbon dioxide or beer gas (a mixture of carbon dioxide and nitrogen gas) coupled to the keg. The pressure source or fluid pressurizing device exerts pressure upon the beer in the keg to push the beer out of the keg via a beer tap. It should be noted that throughout the specification and claims herein, when one element is said to be "coupled" to another, this does not necessarily mean that one element is fastened, secured, or otherwise attached to another element. Instead, the term "coupled" means that one element is either connected directly or indirectly to another element or is in mechanical or electrical communication with another element. To regulate the pressure of beer in the keg and the pressure of beer in the system, a pressure regulator is coupled to the pressure source in a conventional manner and preferably measures the pressure levels within the pressure source and the keg, and also preferably permits a user to change the pressure released to the keg. One comestible fluid pressurizer in the preferred embodiment of the present invention shown in FIG. 2 is a tank of carbon dioxide 24 coupled in a conventional manner to the keg 22 via a pressure line 26. A conventional pressure regulator 28 is attached to the tank 24 for measuring tank and keg pressure as described above. A fluid delivery line 30 is coupled to the keg 22 via a tap 32 also in a conventional manner and runs to downstream dispensing equipment as will be discussed below.

The tank 24, pressure line 26, regulator 28, keg 22, tap 32, delivery line 30, their operation, and connection devices for connecting these elements (not shown) are well known to those skilled in the art and are not therefore described in greater detail herein. However, it should be noted that alternative embodiments of the present invention can employ conventional fluid storage arrangements and comestible fluid pressurizing devices that are significantly different than the keg and tank arrangement disclosed herein while still falling within the scope of the present invention. For example, although not preferred in beer dispensing devices, certain comestible fluid storage devices rely upon the hydrostatic pressure of fluid to provide sufficient fluid pressure for downstream dispensing equipment. In such cases, the comestible fluid need not be pressurized at all, and can be located at a higher elevation than the downstream dispensing equipment to establish the needed dispensing pressure. As another example, other systems employ fluid pumps to pressurize the fluid being dispensed. Depending at least in part upon the storage pressure of the fluid to be dispensed, the fluid storage devices can be in the form of kegs, tanks, bags, and the like. Each such alternative fluid pressurizing arrangement and storage device functions like the illustrated embodiment to supply fluid under pressure from a storage vessel to downstream dispensing equipment (and may or may not have a conventional device for adjusting the pressure exerted to move the fluid from the storage device). These alternative pressurizing arrangements and storage devices are well known to those skilled in the art and fall within the spirit and scope of the present invention.

With continued reference to FIG. 2, the delivery line 30 runs from the keg 22 to a rack heat exchanger 34. The rack heat exchanger 34 is preferably a plate-type heat exchanger supplied with refrigerant as will be described in more detail below. The rack heat exchanger 34 is preferably located in a housing 36 defining a rear portion of the dispensing rack 12, and is mounted therein in a conventional manner. The rack heat exchanger 34 has conventional ports and fittings for connecting beer input and output lines from each of the kegs 22 in the vending stand 10 and for connecting input and output refrigerant lines to the rack heat exchanger 34.

Extending from the rack heat exchanger 34 is a series of beer output lines 38 (one corresponding to each keg 22), only one of which is visible in FIG. 2. Each output line 38 runs to a nozzle assembly 40 that is operable by a user to open and close for dispensing beer as will be described in more detail below.

In the preferred embodiment of the present invention illustrated in FIGS. 1 and 2, a beer dispensing gun 16 is shown also connected to the kegs 22. Normally, either a dispensing gun 16 or a nozzle assembly 40 (not both) would be supplied with beer from a keg 22. Although both could be connected to the same keg 22 via the tap 32 as shown in FIG. 2, such an arrangement is presented for purposes of illustration and simplicity only. The dispensing gun 16 is supplied with beer from the kegs 22 by fluid lines 42, only one of which is visible in FIG. 2. More specifically, the dispensing gun 16 preferably has a plate-type heat exchanger 44 to which the fluid lines 42 run and are connected in a conventional manner via fluid input ports. A fluid output port (described in more detail below) connects the heat exchanger 44 to a nozzle assembly 46 of the beer gun 16. The heat exchanger 44 also has conventional ports and fittings for connecting input and output refrigerant lines to the rack heat exchanger 34.

The vending stand 10 shown in the figures also has a refrigeration system (shown generally at 48 and described in more detail below) for cooling the interior of the vending stand 10 and for cooling refrigerant for the heat exchangers 34, 44. To supply the heat exchangers 34, 44 with cool refrigerant, conventional refrigerant supply lines 50, 52 run from the refrigeration system 48 to the heat exchangers 34, 44, respectively, and are connected to the refrigeration system 48 and the heat exchangers 34, 44 via fittings and ports as is well known to those skilled in the art. Similarly, conventional refrigerant return lines 54, 56 run from the heat exchangers 34, 44, respectively, and are connected to the refrigeration system 48 and the heat exchangers 34, 44 via conventional fittings and ports.

To keep the kegs 22 and connected comestible fluid and refrigerant lines 30, 42, 50, 52, 54, 56 cool, the interior area of the vending stand 10 is preferably insulated in a conventional manner. With respect to the fluid lines 42 running outside of the vending stand 10 to the dispensing gun 16, these lines are preferably kept inside the vending stand 10 when the dispensing gun 16 is not being used. Specifically, the fluid lines 42 can be attached to a reel device or any other conventional line takeup device (not shown) to draw the fluid lines 42 inside the vending stand 10 when the dispensing gun 16 is returned to a holder 58 on the vending stand 10. Such devices and their operation are well known to those skilled in the art and are therefore not described further herein.

Figure 3:
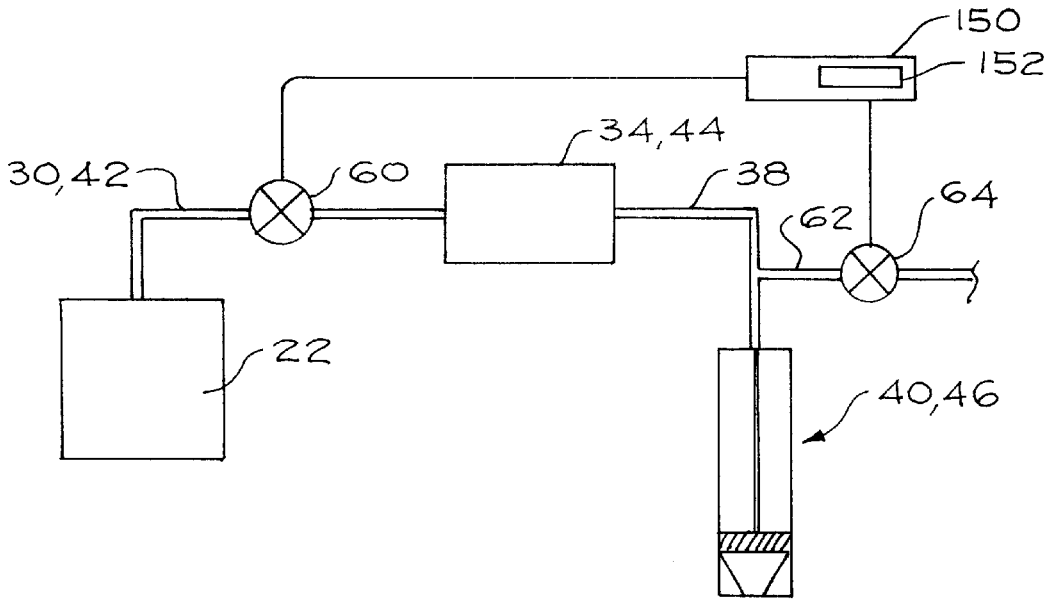
FIG. 3 is a comestible fluid schematic according to a preferred embodiment of the present invention.

With reference to FIG. 3, the flow of beer through the present invention is now described in greater detail. As used herein and in the appended claims, the term "fluid line" refers collectively to those areas through which fluid passes from the source of fluid (e.g., kegs 22) to the dispensing outlets 70, 130. A "fluid line" can refer to the entire path followed by fluid through the system or can refer to a portion of that path.

As described above, a delivery line 30 runs from each keg 22 to the rack heat exchanger 34 and is connected to fluid input lines on the rack heat exchanger 34 in a conventional manner. The delivery line 30 is preferably fitted with a valve 60 for at least selectively restricting but most preferably selectively closing the delivery line 30. For the sake of simplicity, the valve 60 is preferably a conventional pinch valve, but can instead be a diaphragm valve or any other valve preferably capable of quickly closing and opening the delivery line 30. The valve 60 can be fitted over the delivery line 30 as is conventional in many pinch valves, or can instead be spliced into the delivery line 30 as desired.

As mentioned above, a fluid output line 38 runs from the rack heat exchanger 34 to each nozzle assembly 40. Most preferably, the output line 38 and the connected nozzle assembly 40 are an extension of the rack heat exchanger 34 at its fluid output port (not shown). A purge line 62 preferably extends from the output line 38 or from nozzle assembly 40 as shown in FIG. 3, and is connected to the output line or nozzle assembly in a conventional manner. The purge line 62 is preferably fitted with a purge valve 64 for selectively closing the purge line 62. The purge valve 64 is preferably also a pinch valve, but can instead be any other valve type as described above with reference to the valve 60 on the delivery line 30. As will now be described in more detail, the nozzle assembly 40 is supplied with beer from the heat exchanger 44 and is actuatable to open and close for selectively dispensing beer.

Figure 4:
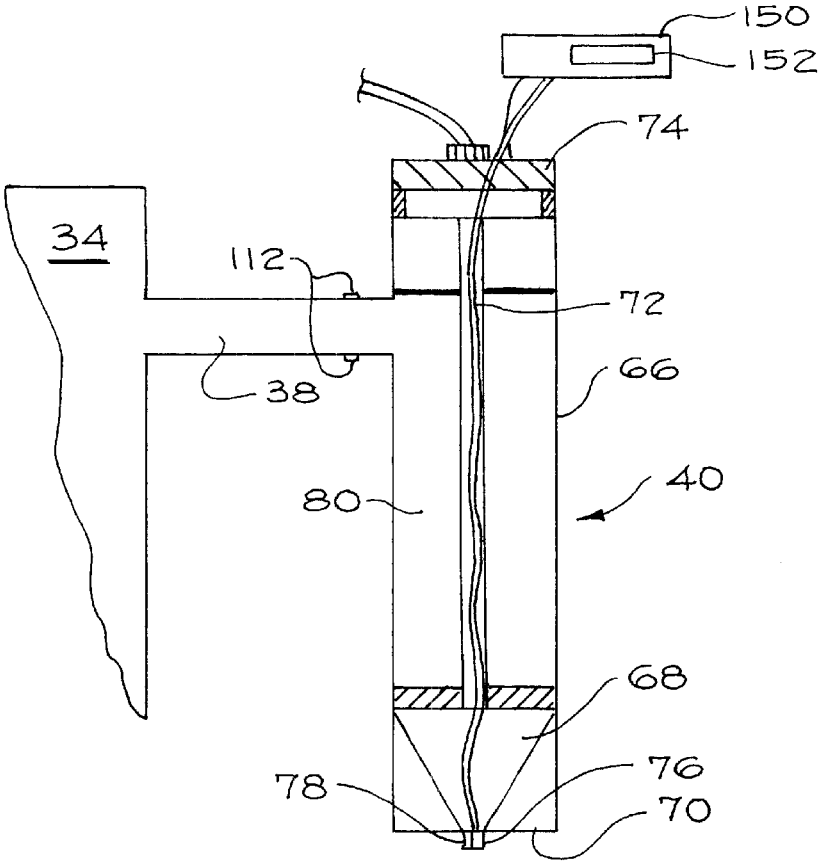
FIG. 4 is an elevational cross section view of a rack nozzle assembly shown in FIGS. 1 and 2.

The nozzle assembly 40 (see FIG. 4) includes a housing 66, a valve 68 movable to open and close an dispensing outlet 70, and a fluid holding chamber or reservoir 80 defined at least in part by the housing 66 and more preferably at least in part by the housing 66 and the valve 68. The housing 66 is preferably elongated as shown in the figures. For reasons that will be described below, the housing 66, valve 68, and dispensing outlet 70 are preferably shaped to permit the valve 68 to move in telescoping relationship a distance within the housing 66. In the preferred embodiment shown in the figures, the housing 66, valve 68, and dispensing outlet 70 have a round cross-sectional shape, thereby defining a tubular internal area of the housing 66. The valve 68 is preferably a plunger-type valve as shown in FIG. 4, where the valve 68 provides a seal against the inner wall or walls (depending upon the particular housing 66 shape) of the housing 66 through a range of positions until an open position is reached. Although one open position is possible in such a valve, the valve 66 is more preferably movable through a range of open positions also, thereby providing for different sizes for the dispensing outlet 70 and a corresponding range of flow speeds from the dispensing outlet 70. To actuate the valve 68, a valve rod 72 is attached at one end to the valve 68 and extends through the housing 66 to an actuator 74 preferably attached to the housing 66. The actuator 74 is preferably controllable by a user or system controller 150 in a conventional manner to position the valve 68 in a range of different positions in the housing 66. This range of positions includes at least one open position in which the dispensing outlet 70 is open to dispense beer and a range of closed positions defined along a length of the housing 66 in which the dispensing outlet 70 is closed to prevent the dispense of beer. One having ordinary skill in the art will appreciate that the entire housing 66 of the nozzle assembly 40 need not necessarily be elongated or tubular in shape. Where the preferred plunger-type valve 68 is employed (other nozzle elements described below being capable of performing the functions of a plunger-type valve 68 as discussed below), only the portion of the housing 66 that meets with the valve 68 to provide a fluid-tight seal through the range of closed valve positions should be elongated, tubular, or otherwise have a cavity therein with a substantially constant cross-sectional area along a length thereof.

The actuator 74 is preferably pneumatic, and is preferably supplied by conventional lines and conventional fittings with compressed air from an air compressor (not shown), compressed air tank (also not shown), or even from the tank 24 connected to and pressurizing the kegs 22. It will be appreciated by one having ordinary skill in the art that numerous other actuation devices and assemblies can be used to accomplish the same function of moving the valve 68 with respect to the housing 66 to open the dispensing outlet 70. For example, the actuator 74 need not be externally powered to both extended and retracted positions corresponding to open and closed positions of the nozzle valve 68. Instead, the actuator 74 can be externally powered in one direction (such as toward an extended position pushing the nozzle valve 68 open) and biased toward an opposite direction by the pressurized beer in the nozzle assembly 40 in a manner well known to those skilled in the art. As another example, the pneumatic actuator 74 can be replaced by an electrical or hydraulic actuator or a mechanical actuator capable of moving the valve by gearing (e.g., a worm gear turning the valve rod 72 via gear teeth on the valve rod, a rack and pinion set, and the like), magnets, etc. In this regard, the valve 68 need not necessarily be attached to and be movable by a valve rod 72. Numerous other valve actuation elements and assemblies exist that are capable of moving the valve 68 to open and close the dispensing outlet. However, the actuation element or assembly in all such cases is preferably controllable over a range of positions to move the valve 68 to desired locations in the housing 66. Such other actuation assemblies and elements fall within the spirit and scope of the present invention.

In highly preferred embodiments of the present invention, a trigger sensor 76 and a shutoff sensor 78 are mounted at the tip of the nozzle housing 66 or (as shown in FIG. 4) at the tip of the valve 68. Both sensors 76, 78 are connected in a conventional manner to a system controller 150 for controlling the valves 60, 62, 76 to dispense beer from the nozzle assembly 40 and to stop beer dispense at a desired time. Preferably, the actuation sensor 76 is a mechanical trigger that is responsive to touch, while the trigger sensor 78 is an optical sensor responsive to the visual detection of beer or its immersion in beer. Of course, many other well known mechanical and electrical sensors can be used to send signals to the system controller 150 for opening and closing the valve 68 of the nozzle assembly 40. Such sensors include without limitation proximity sensors, motion sensors, temperature sensors, liquid sensors, and the like. However, the sensors used (and particularly, mechanical sensors such as the trigger sensor 76 in the preferred embodiment of the present invention) should be selected to operate in connection with a wide variety of beer receptacles and receptacle shapes. For example, where a selected trigger sensor operates by detecting a bottom surface of a beer receptacle, the sensor should be capable of detecting bottom surfaces of all types of beer receptacles, including without limitation surfaces that are flat, sloped, opaque, transparent, reflective, non-reflective, etc.

In a beer dispensing operation, a user places a vessel such as a glass or mug beneath the nozzle assembly 40 corresponding to the type of beer desired. The vessel is raised until the trigger sensor 76 is triggered (preferably by contact with the bottom of the vessel in the preferred case of a manual trigger sensor). Upon being triggered, the trigger sensor 76 sends a signal to the system controller 150 via an electrical connection thereto (e.g., up the valve rod 72, out of the actuator 74 or housing 66 and to the system controller 150, up the housing 66 and to the system controller 150, etc.) or transmits a wireless signal in a conventional manner to be received by the system controller 150. The system controller 150 responds by closing the valve 60 on the delivery line 30 from the keg 22. At this stage, the keg 22, delivery line 30, heat exchanger 34, output line 38, and nozzle assembly 40 contain beer under pressure near or equal to keg pressure. This pressure is generally too large for proper beer dispense from the nozzle assembly 40. As such, the pressure at the nozzle assembly 40 is preferably reduced to a desirable amount based upon the desired dispense characteristics (e.g., the amount of beer head desired) and the beer type being dispensed. Pressure at the nozzle assembly 40 can be reduced in several ways.

For example, the system controller 150 can send or transmit a signal to the purge valve 64 to open the same for releasing beer out of the purge line 62. Valve controllers responsive to such signals are well known to those skilled in the art and are not therefore described further herein. The purge valve 64 is preferably open for a sufficient time to permit enough beer to exit to lower the pressure in the nozzle assembly 40. The amount of purge valve open time required depends at least in part upon the amount of pressure drop desired, the type of beer dispensed, and the dimensions of the purge line 62 and purge valve 64. Preferably, the system controller 150 is pre-programmed with times required for desired pressure drops for different beer types. The user therefore enters the type of beer being dispensed via the controls 20, at which time the system controller 150 references the amount of time needed to drop pressure in the nozzle assembly 40 to a sufficiently low level for proper beer dispense. After the pressure in the nozzle assembly 40 has dropped sufficiently, the system controller 150 sends or transmits a signal to the purge valve 64 to close and sends a signal to the actuator 74 to open the nozzle valve 68.

As another example, pressure in the nozzle assembly 40 can be reduced by enlarging some portion of the area within which the beer is contained. Although such enlargement can be performed, e.g., by expanding the fluid line or a portion of the heat exchanger 34 (i.e., moving a wall or surface defining a portion of the fluid line or heat exchanger 34), it is most preferred to enlarge the fluid holding chamber 80. Accordingly, the valve 68 is movable to increase the size of the fluid holding chamber 80 in the housing 66 of the nozzle assembly 40. The valve preferably defines a surface or wall of the fluid holding chamber. As discussed above, the valve 68 is preferably movable through a range of closed positions in the nozzle assembly 40, and more preferably is in telescoping relationship within the housing 66. When the system controller 150 receives the trigger signal from the trigger sensor 76, the system controller 150 sends or transmits a signal to the actuator to move the valve toward the dispensing outlet 70. This movement increases the volume of the fluid holding chamber 80 in the nozzle assembly 40, thereby lowering the pressure in the nozzle assembly 40. By the time the valve 68 reaches the dispensing outlet 70 and opens to dispense the beer, the pressure within the nozzle assembly has lowered to a desired dispensing pressure.

Still other conventional pressure-reducing devices and assemblies can be used to lower the pre-dispense pressure in the nozzle assembly 40. For example, one or more walls defining the fluid holding chamber 80 can be movable to expand the fluid holding chamber, such as by one or more telescoping walls laterally movable toward and away from the center of the fluid holding chamber 80 prior to movement of the nozzle valve 68, a flexible wall of the fluid holding chamber 80 (such as an annular flexible wall) deformable to increase the volume of the fluid holding chamber 80, etc. A wall of the latter type can be formed, for example, in a bulb shape and be normally constricted by a band, cable, or other tightening device and be loosened prior to dispense to increase the volume of the fluid holding chamber 80. Such other devices and assemblies are well known to those skilled in the art and fall within the spirit and scope of the present invention.

It should be noted that more than one pressure reducing device or assembly can be employed to lower the nozzle dispense pressure to the desired level. The nozzle assembly shown in FIGS. 3 and 4, for example, includes the purge line 62 and purge valve 64 assembly and also includes a telescoping nozzle valve 68. However, in practice only one such device or assembly is typically necessary. Therefore, where the most preferred telescoping nozzle assembly is employed as shown in FIGS. 3 and 4, the need for a purge line 62 and purge valve 64 is either reduced or eliminated. Also, where the purge line 62 and the purge valve 64 are employed as also shown in FIGS. 3 and 4, the need for a valve 68 having a range of closed positions is reduced or eliminated. In other words, the valve 68 can simply have an open and a closed position. Depending upon the speed at which the pressure reducing device or assembly operates and the dispense speed of the nozzle assembly, it is even possible to eliminate the valve 60 on the delivery line 30 running from the keg 22. Specifically, a lower pressure at or near the nozzle assembly 40 does not necessarily reduce fluid pressure upstream of the rack heat exchanger 34 (i.e., in the delivery line 30) due to the response lag normally experienced from a pressure drop at a distance from the nozzle assembly. A pressure drop that is sufficiently fast at the nozzle assembly 40 can permit a user to dispense beer at or near a desired dispense pressure in the nozzle assembly before higher pressure upstream of the heat exchanger 34 has time to be transmitted to the nozzle assembly 40, thereby eliminating the need to actuate the pinch valve 60 on the delivery line 30 or eliminating the need for the pinch valve altogether.

Pressure drop in the nozzle assembly 40 prior to dispense can be performed in a number of different manners as described above, including the preferred valve arrangement shown in the figures. Although such a plunger-type valve is preferred, other conventional valve types can instead be used (including without limitation pinch valves., diaphragm valves, ball valves, spool valves, and the like) where one or more of the earlier-described alternative pressure reduction devices are employed.

At substantially the same time or soon after the system controller 150 sends a signal to the actuator 74 to open the nozzle valve 68, the system controller 150 also preferably activates the shutoff sensor 78 (if not already activated). Preferably, the shutoff sensor 78 is selected and adapted to detect the presence of fluid near or at the level of the nozzle valve 68 or the end of the nozzle housing 66. The shutoff sensor 78 can perform this function by detecting the proximity of the surface of the beer in the vessel, by detecting its immersion in beer in the vessel, by detecting a temperature change corresponding to removal of the beer from the sensor, and the like. Most preferably however, the shutoff sensor 78 optically detects its immersion in the beer in a manner well known in the fluid detection art.

The system controller 150 permits beer to be poured from the nozzle assembly 40 so long as the system controller 150 does not receive a signal from the shutoff sensor 78 indicating otherwise. The nozzles 14 of the preferred embodiment of the present invention are sub-surface fill nozzles, meaning that beer is injected into the already-dispensed beer in the vessel. Due to the preferred shape of the nozzle valve 68 shown in FIGS. 3 and 4, beer exits the dispensing outlet 70 radially in all directions within the vessel, thereby distributing the pressure of the beer better (to help reduce carbonation loss and foaming) than a straight flow dispense. It should be noted, however, that flow from the dispensing outlet does not need to be radial flow in all directions, and can instead be flow in a stream, fan, or in any other flow shape desired. After an initial amount of beer has been poured into the vessel, the tip of the nozzle assembly 40 is preferably kept beneath the surface of the beer in the vessel. Additional beer dispensed into the vessel is therefore injected with less foaming and with less loss of carbonation. When the user is done dispensing beer into the vessel, the user drops the vessel from the nozzle assembly 40. The shutoff sensor 78 detects that it is no longer immersed in beer, and sends a signal in a conventional manner to the system controller 150. Upon receiving this signal, the system controller 150 sends a signal to the actuator 74 to return the nozzle valve 68 to a closed position, thereby sealing the dispensing outlet 70 and stopping the dispense of beer.

By virtue of the above nozzle assembly arrangement, pressure can be maintained throughout the system—from the kegs 22 to the nozzle valves 68. Most preferably, the equilibrium state of the system is pressure substantially equal to the storage pressure of beer in the kegs (or the "rack pressure"). Such pressure throughout the system prevents loss of carbonation in the system due to low or atmospheric pressures, prevents over-carbonation due to undesirably high pressures, enables faster beer dispense, and permits better dispense control.

Several alternatives exist to the use of the trigger sensor 76 and the shutoff sensor 78 on the nozzle assembly for controlling beer dispense. For example, the nozzle assembly 40 can be operated directly by a user via the controls 20, in which case the user would preferably directly indicate the start and stop times for beer dispense. As another example where the size of the vessel into which beer is dispensed is known, this information can be entered by a user into the system controller 150 via the controls 20. In operation, the system is triggered to start dispensing beer by a trigger sensor such as the trigger sensor 76 discussed above, by a user-actuatable button on the controls 20, by one or more sensors located adjacent the nozzle assembly for detecting the presence of a vessel beneath the nozzle 14 in a manner well known to those skilled in the art, and the like. Where a desired amount of beer is to be dispensed, beer dispense can be stopped in a number of different ways, such as by a shutoff sensor like the shutoff sensor 78 described above, one or more sensors located adjacent to the nozzle assembly 40 for detecting the removal of the vessel from beneath the nozzle 14, by a conventional flowmeter located anywhere along the system from the keg 22 to the nozzle valve 68 (and more preferably at the dispensing outlet 70 or in the housing 66) for measuring the amount of flow past the flowmeter, or by a conventional pressure sensor also located anywhere along the system but more preferably located in the nozzle assembly 40 to measure the pressure of beer being dispensed. In both latter cases, dimensions of the nozzle assembly would be known and preferably programmed into the system controller 150 in a conventional manner. For example, if a flowmeter is used, the cross-sectional area of the nozzle 14 at the flowmeter would be known to calculate the amount of flow past the flowmeter. If a pressure sensor is used, the size of the dispensing outlet 70 when the nozzle valve 68 is open would be known to calculate the amount of flow through the dispensing outlet 70 per unit time. Using a conventional timer 152 preferably associated with the system controller 150, the system controller 150 can then send a signal to the actuator 74 to close the nozzle valve 68 after an amount of time has passed corresponding to the amount of fluid dispense desired (e.g., found by dividing the amount of fluid desired to be dispensed by the flow rate per unit time). Because the pressure and flow rate vary during dispensing operations, alternative embodiments employing a flowmeter or pressure sensor continually monitor beer flow or pressure, respectively, to update the flow rate in a conventional manner. When the desired amount of beer has been measured via the flowmeter or pressure sensor, the system controller 150 sends a signal to the actuator 74 to close the nozzle valve 68.

Devices and systems for calculating flow amount such as those just described are well known to those skilled in the art and fall within the spirit and scope of the present invention. It should be noted, however, that such devices and systems need not necessarily be used in conjunction with the nozzle valve 68 as just described, but can instead be used to control beer supply to the nozzle assembly 40. For example, such devices and systems can be used in connection with a valve such as valve 60 upstream of the rack heat exchanger 34 to control fluid supply to the nozzle assembly 40, which itself would preferably be timed to open and close with or close to the opening and closing times of the upstream valve. Whether the device or system calculates flow based upon valve open time (like the pressure sensor example described above) or measured flow speed with the cross-sectional flow area known (like the flowmeter example also described above), control of valves other than the nozzle valve 68 can be used to dispense a desired amount of beer from the nozzle assembly 40.

Yet another manner in which a desired amount of beer can be dispensed from the nozzle assembly 40 is by closing a valve such as valve 60 upstream of the nozzle assembly 40 and dispensing all fluid downstream of the closed valve 60. The valve 60 can be positioned a sufficient distance upstream of the nozzle assembly 40 so that the amount of beer from the valve 60 through the nozzle assembly 40 is a known set amount, such as 12 ounces, 20 ounces, and the like. By closing the valve 60 and dispensing the fluid downstream of the valve 60, a known amount of beer is dispensed from the nozzle assembly 40. If shorter fluid line distances between the valve 60 and the nozzle assembly 40 are desired, the fluid line can have one or more fluid chambers (not shown) with known capacities that are drained after the valve 60 is closed. Additionally, multiple valves 60 located in different positions upstream of the nozzle assembly 40 can be employed to each dispense a different (preferably standard beverage size) fluid amount from the nozzle assembly 40. The user and/or system controller 150 can therefore selectively close one of the valves corresponding to the desired dispense amount. To assist in draining the fluid line downstream of the valve 60 closed, the valve can have a conventional drain line or port associated therewith (e.g., on the valve 60 itself or immediately downstream of the valve 60) that opens when the valve 60 is closed and that closes when the valve is opened. Similarly, to assist in filling the fluid line downstream of the valve 60 when the nozzle valve 68 is closed and the valve 60 is open after dispense, a conventional vent valve or line can be located on the nozzle assembly 40 and can open while the fluid line is filling and close when the fluid line has been filled.

Although valve control upstream of the nozzle assembly 40 can be used to dispense a set amount of beer, such an arrangement is generally not preferred due to inherent pressure variations and pressure propagation times through the system resulting in lower dispense accuracy. However, pressure variations and pressure propagation times are significantly affected by the particular location of the valve(s) 60 and the type and size of heat exchanger 34 used. Therefore, the problems related to such valve control can be mitigated by using heat exchangers having low pressure effects on comestible fluid in the system or by locating the valve(s) 60 between the heat exchanger 34 and the nozzle assembly 60.

It should be noted that because the amount of beer dispensed from the nozzle assemblies 40 can be measured on a dispense by dispense basis via the flowmeter or the timed pressure sensor arrangements described above, the total amount of beer dispensed from any or all of the nozzle assemblies can be monitored in a conventional manner, such as by the system controller 150. Among other things, this is particularly useful to monitor beer waste, pilferage, and consumer preferences and demand.

Figure 5:
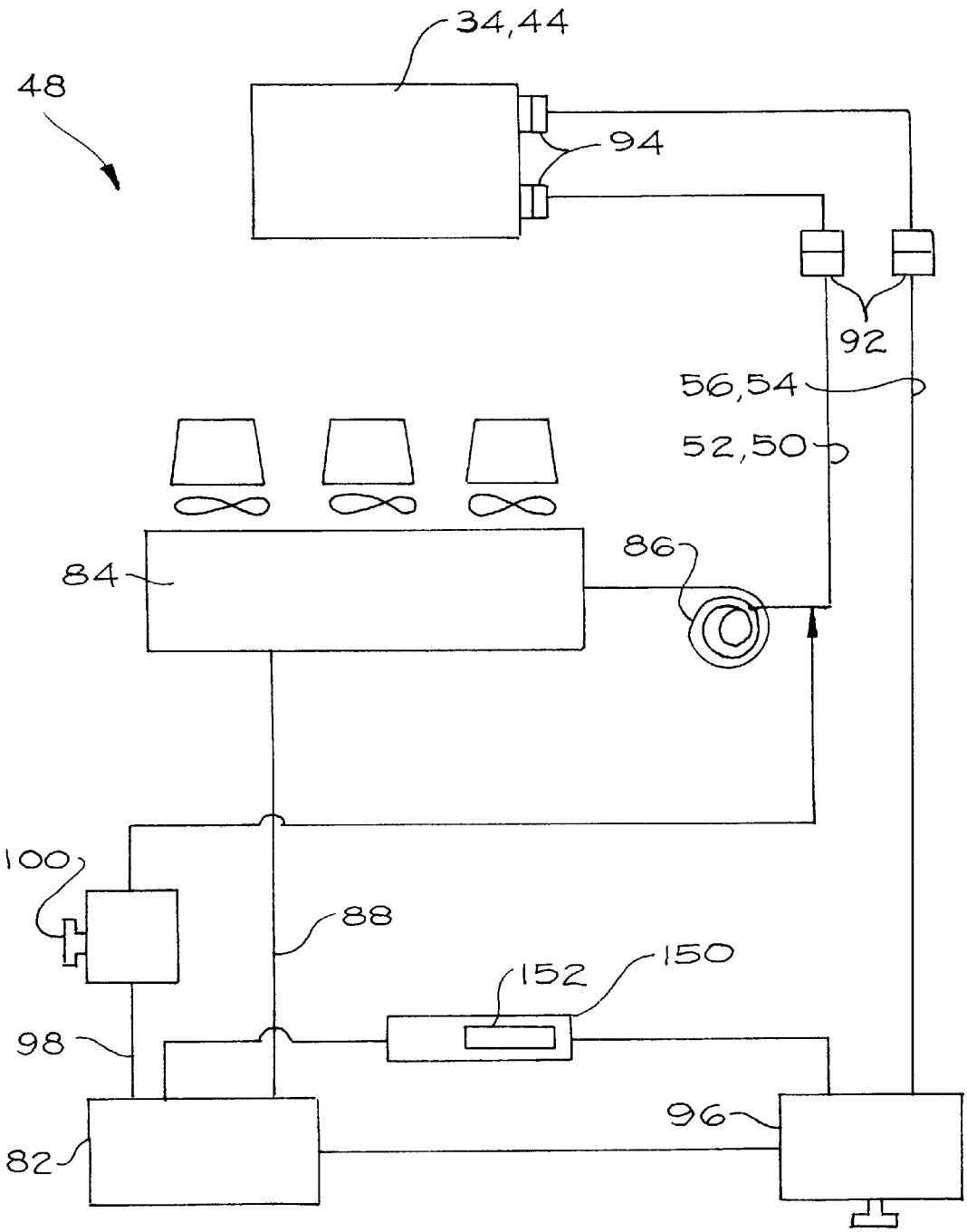
FIG. 5 is a refrigeration schematic according to a preferred embodiment of the present invention.
Figure 6:
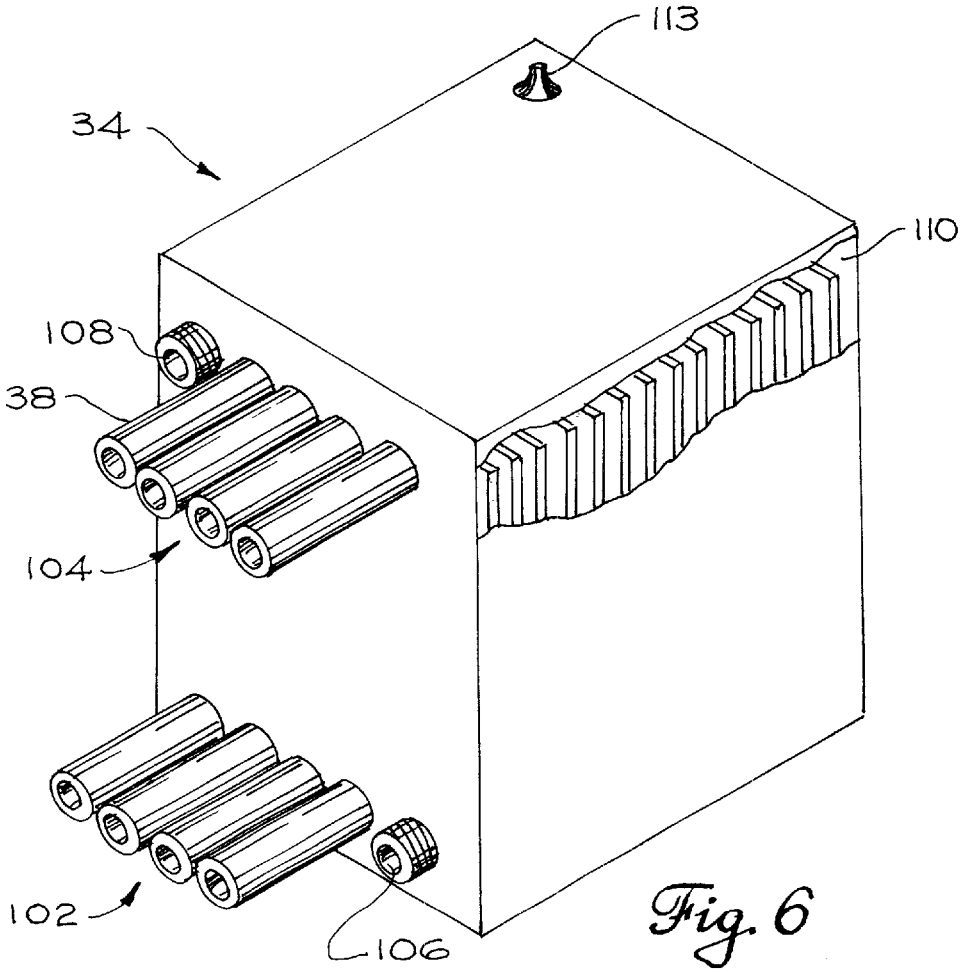
FIG. 6 is a perspective view, partially broken away, of the rack heat exchanger used in the vending stand shown in FIGS. 1 and 2.

FIGS. 5 and 6 illustrate the refrigeration system of the present invention. In contrast to conventional vending stands, the present invention does not require an insulated or refrigerated keg storage area. Eliminating the need for a keg storage area refrigeration system in lieu of the heat exchanger refrigeration system described below represents a significant cost and maintenance savings and results in a much more efficient refrigeration system. An insulated and refrigerated keg storage area is preferred particularly in applications where a keg is dispensed over the period of two or more days. However, in high-volume dispensing applications such as concession stands at sporting events and festivals, kegs are spent quickly enough to eliminate refrigeration after tapping to prevent spoilage. A refrigeration system for cooling the keg storage area in the vending stand 10 illustrated in the figures is not shown, but can be employed if desired. Such systems and their operation are well known to those skilled in the art and are not therefore described further herein.

With reference first to FIG. 5, which is a schematic representation of the refrigeration system 48 of the present invention, the four primary elements of a refrigeration system are shown: a compressor 82, a condenser 84, an expansion valve (in the illustrated preferred embodiment, a triple-feed wound capillary tube 86), and an evaporator (in the illustrated preferred embodiment, the rack heat exchanger 34 or the dispensing gun heat exchanger 44). Although many different working fluids can be used in the refrigeration system 48, such as Ammonia, R-12, or R-134a, or R-404a, the working fluid is preferably R-22.

In a vapor compressor refrigeration cycle such as that employed in the preferred embodiment of the present invention, the compressor 82 receives relatively low pressure and high temperature refrigerant gas and compresses the refrigerant gas to a relatively high pressure and high temperature refrigerant gas. This refrigerant gas is passed via gas line 88 to the condenser 84 for cooling to a relatively high pressure and low temperature refrigerant liquid. Although several different condenser types exist, the condenser 84 is preferably a conventional air-cooled condenser having at least one fan for blowing air over lines in the condenser to cool the refrigerant therein. After passing from the condenser 84, the relatively high pressure, low temperature refrigerant liquid is passed through the triple feed wound capillary tube 86 to lower the pressure of the refrigerant, thereby resulting in a relatively low pressure and low temperature refrigerant liquid. This refrigerant liquid is then passed to the heat exchanger 34, 44 where it absorbs heat from the beer being cooled. The resulting relatively high temperature and low pressure refrigerant gas is then passed to the compressor 82 (via a valve 96 as will be discussed below) for the next refrigeration cycle. Most preferably, the heat exchanger 34, 44 is connected to the rest of the refrigeration system 48 by conventional releasable fittings 92 (and most preferably, conventional threaded flair fittings) so that the unit being refrigerated by the refrigeration system 48 can be quickly and conveniently changed. Similarly, the refrigerant lines connected to the heat exchanger 34, 44 are preferably connected thereto by conventional releasable threaded flair fittings 94. It will be appreciated by one having ordinary skill in the art that such fittings can take any number of different forms. Such fittings, as well as the fittings and connection elements for connecting all elements of the refrigeration system 48 to their lines are well known to those skilled in the art and are not therefore described further herein.

Any of the lines connecting the elements of the refrigeration system 48 can be rigid. However, these lines are more preferably flexible for ease of connection and maintenance, and preferably are made of transparent material to enable flow characteristics and cleanliness observation. In particular, where the refrigerant supply and return lines 50, 52, 54, 56 run to and from the dispensing gun 16, these lines should be flexible to permit user movement of the dispensing gun 16. Such lines are well known in the refrigeration and air-conditioning art. For example, flexible automotive air conditioning hose can be used to connect the heat exchanger 44 to the remainder of the refrigeration system 48.

The refrigeration system 48 of the present invention can be used to control the temperature at which beer is dispensed from the dispensing gun 16 and from the nozzle assembly 40. It is highly desirable to control the amount of cooling of the heat exchanger 34, 44 in the present invention. As is well known in the art, the pressure of beer must be kept within a relatively narrow range for proper beer dispense, and this pressure is significantly affected by the temperature at which the beer is kept. Although it is desirable to keep the beer cool in the nozzle assembly 40, most preferably the beer temperature is controlled by control of the refrigeration system 48 as described below. By controlling the temperature of beer flowing through the system by refrigeration system control, the pressure changes called for by movement of the nozzle valve 68 as described above also can be better controlled, as well as the pressure of beer in the system (an important factor in measuring beer dispense as also described above). For example, if a lower equilibrium beer pressure is desired in the nozzle assembly 40 prior to moving the nozzle valve 68 to drop the beer pressure before beer dispense, the system controller 150 can control the refrigeration system (as described in more detail below) to increase cooling at the heat exchanger 34, thereby lowering beer pressure at the nozzle assembly 40. Such control is useful in other embodiments of the present invention described above for controlling beer pressure and temperature in the system.

To control the refrigeration system 48, a conventional evaporator pressure regulator (EPR) valve 96 is preferably located between the heat exchanger 34, 44 and the compressor 82. The EPR valve 96 is connected in the refrigerant return line 54, 56 in a conventional manner. The EPR valve 96 measures the pressure of refrigerant in the refrigerant return line 54, 56 (and the heat exchanger 34, 44) and responds by either constricting flow from the heat exchanger 34, 44 or further opening flow from the heat exchanger 34, 44. Either change alters the pressure upstream of the EPR valve 96 in a manner well known to those skilled in the art. Specifically, by adjusting the valve, the pressure within the heat exchanger 34, 44 can be increased or decreased. Increasing refrigerant pressure in the heat exchanger 34, 44 lowers the refrigerant's ability to absorb heat from the beer in the heat exchanger 34, 44, thereby lowering the cooling effect of the heat exchanger 34, 44 and increasing the temperature of beer passed therethrough. Conversely, decreasing refrigerant pressure in the heat exchanger 34, 44 increases the refrigerant's ability to absorb heat from the beer in the heat exchanger 34, 44, thereby increasing the cooling effect of the heat exchanger 34, 44 and lowering the temperature of beer passed therethrough. The pressure upstream of the EPR valve 96 can be precisely controlled by adjusting the EPR valve 96 to result in refrigerant of varying capacity to cool, thereby precisely controlling the temperature of beer dispensed and allowing the refrigeration system 48 to run continuously independently of loading placed thereupon. This is in contrast to conventional refrigeration systems for comestible fluid dispensers in that conventional refrigeration systems generally must cycle on and off when the loading on such systems becomes light. The EPR valve is preferably connected to and automatically adjustable in a conventional manner by the system controller 150, but can instead be manually adjusted by a user if desired. In this regard, a temperature sensor (not shown) is preferably located within or adjacent to the nozzle assembly 40, 46, the heat exchanger 34, 44, or the keg 22 to determine the temperature of beer in the system and to provide the system controller 150 with this information. The system controller 150 can then adjust the EPR valve 96 to change the beer temperature accordingly.

Another manner by which the refrigeration system 48 can be adjusted to control cooling of the heat exchanger 34, 44 is also shown in the schematic diagram of FIG. 5. Specifically, a bleed line 98 is preferably connected at the discharge end of the compressor 82 and at another end to the refrigerant supply line 50, 52 running from the capillary tube 86 to the heat exchanger 34, 44. The bleed line 98 is fitted with a conventional bypass regulator 100 which measures the pressure of refrigerant in the refrigerant supply line 50, 52 and which responds by either keeping the bleed line 98 shut or by opening an amount to bleed hot refrigerant from the compressor 82 to the refrigerant supply line 50, 52. The bleed line 98 and bypass regulator 100 are preferably connected to the compressor 82 and refrigerant supply line 50, 52 by conventional fittings. Hot refrigerant bled from the compressor 82 by the bypass regulator mixes with and warms cold refrigerant liquid in the refrigerant supply line 50, 52, thereby lowering the refrigerant's capacity to absorb heat from beer in the heat exchanger 34, 44 and raising the temperature of beer passing through the heat exchanger 34, 44. The amount of hot refrigerant gas mixed with the refrigerant in the refrigerant supply line 50, 52 can be precisely controlled by the bypass regulator to result in refrigerant of varying capacity to cool, thereby precisely controlling the temperature of beer dispensed and allowing the refrigeration system 48 to run continuously independently of loading placed thereupon. As mentioned above, this is in contrast to conventional refrigeration systems for comestible fluid dispensers in that conventional refrigeration systems generally must cycle on and off when the loading on such systems becomes light. The bypass regulator 100 is preferably connected to and automatically adjustable in a conventional manner by the system controller 150, but can instead be manually adjusted by a user if desired. In this regard, a temperature sensor (not shown) is preferably located within or adjacent to the nozzle assembly 40, 46, the heat exchanger 34, 44, or the keg 22 to determine the temperature of beer in the system and to provide the system controller 150 with this information. The system controller 150 can then adjust the bypass regulator 100 to change the beer temperature accordingly.

It should be noted that the EPR valve 96 and the bypass regulator 100 can take many different forms well known to those skilled in the art, each of which is effective to open or close the respective lines to change the pressure of refrigerant in the system or to inject hot refrigerant into a cold refrigerant line. These refrigerant system components act at least as valves and most preferably as regulators to open or close automatically in response to threshold pressures being reached in the refrigerant lines detected (thereby automatically keeping the refrigerant system 48 operating at a capacity sufficient to maintain a desired beer temperature). Although an EPR valve 96 and a bypass regulator 100 are included in the preferred embodiment of the present invention illustrated in the figures, one having ordinary skill in the art will recognize that system operation can be controlled by one of these devices or any number of these devices. Also, if either or both of these devices are simply valves rather than regulators, refrigeration system control is still possible by measuring the temperature and/or pressure of beer flowing through the heat exchangers 34, 44 as described above and by operating the valves 96, 100 via the system controller 150 in response to the measured temperature and/or pressure.

With reference to FIG. 6, the rack heat exchanger 34 of the preferred embodiment of the present invention can be seen in greater detail. The rack heat exchanger 34 is preferably a plate heat exchanger having at least one beer input port 102, one beer output port 104, one refrigerant input port 106, and one refrigerant output port 108 in a conventional housing. In the illustrated preferred embodiment, the rack heat exchanger is a plate heat exchanger having four separate flow paths through the heat exchanger 34 for four different beers. Accordingly, the illustrated rack heat exchanger 34 has four different beer input ports 102 and four different beer output ports 104, and has one refrigerant input port 106 and one refrigerant output port 108 for running refrigerant through all sections of the rack heat exchanger 34. It will be appreciated by one having ordinary skill in the art that the rack heat exchanger 34 can be divided into any number of separate sections (beer flow paths) corresponding to any number of desired beers run to the dispensing rack 12, and that more refrigerant input and output ports 106, 108 can be employed if desired. Indeed, the rack heat exchanger 34 can even have dedicated refrigerant input and output ports 106, 108 for each section of the rack heat exchanger 34. Alternatively, the dispensing rack can have a separate heat exchanger 34 with dedicated refrigerant input and output ports 106, 108 for each beer fed to the dispensing rack 12. Plate-type heat exchangers having multiple fluid passageways are well known to those skilled in the art and are not therefore described further herein. As described above, a delivery line 30 runs to each fluid input port from a respective keg 22 and is coupled thereto in a conventional manner with conventional fittings. Similarly, the refrigerant supply line 50 and the refrigerant return line 54 run to the refrigerant input and output ports 106, 108, respectively, and are coupled thereto in a conventional manner with conventional fittings. Each output port 108 of the rack heat exchanger 34 preferably extends to the nozzle housing 66.

Figure 6A:
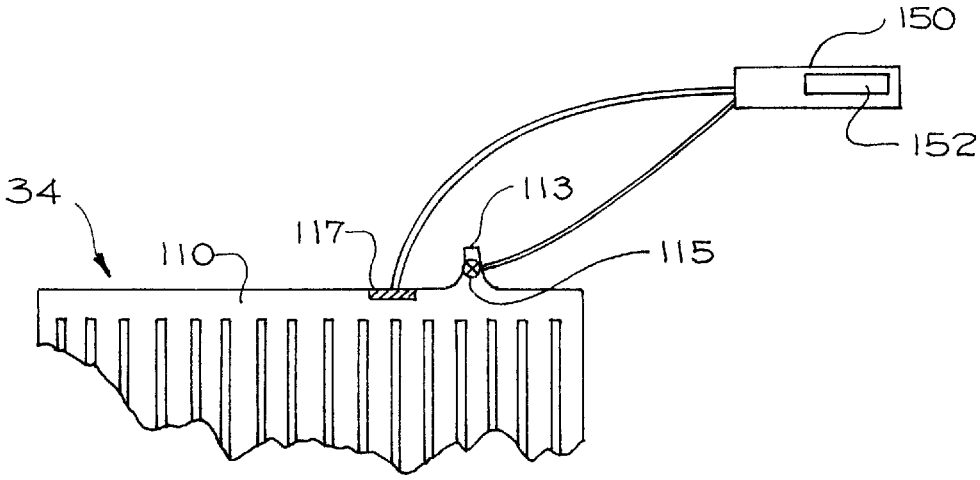
FIG. 6*a* is an elevational cross section view of the rack heat exchanger shown in FIG. 6.

A problem that can arise in using conventional plate-type heat exchangers for dispensing comestible fluid is that such heat exchangers typically have a head space therein. Head space is undesirable in comestible fluid systems because such areas are hard to clean (in some cases, they never become wet or immersed in the fluid being cooled), create pressure regulation problems in the system, and can harbor bacteria growth and possibly even spoil beer in the system. With reference to FIGS. 6 and 6*a*, the head space 110 is an area of the heat exchanger interior that is at a higher elevation than the beer output ports 104, and is not filled with fluid during normal system operation. FIGS. 6 and 6*a* show the plate-type heat exchanger of the present invention in greater detail. As is known to those skilled in the art, fluid to be cooled is kept separated from refrigerant by one or more plates within the heat exchanger, one side of each plate being exposed to or immersed in the refrigerant while the other side of each plate is exposed to or immersed in the fluid being cooled. To prevent the problems associated with head space mentioned above, the rack heat exchanger 54 preferably has a vent port 113 at the top of the rack heat exchanger 54. The vent port 113 has a vent valve 115 that can be actuated to open and close the vent port 113. The vent valve 115 can be any valve capable of opening and closing the vent port, but more preferably is a check valve only permitting air and gas exit from the rack heat exchanger 54. The rack heat exchanger 54 also preferably has a sensor 117 capable of detecting the presence of liquid at the top of the rack heat exchanger 54. The sensor 117 can one of many types, including without limitation an optical sensor for detecting the proximity of fluid in the head space of the rack heat exchanger 54, a liquid sensor responsive to immersion in liquid, a temperature sensor responsive to the temperature difference created by the presence or contact of liquid upon the sensor, a mechanical or electromechanical liquid level sensor, and the like. The vent port 113, vent valve 115, sensor 117, and their connection and operation are conventional in nature. Although the vent valve 115 can be manually opened and closed (also in a conventional manner), most preferably the vent valve 115 is controlled by the system controller 150 to which it and the sensor 117 are connected. However, it should be noted that the vent valve 115 and the sensor 117 can be part of a separately powered and self-contained electrical circuit that receives signals from the sensor 117 and that controls the vent valve 115 accordingly. Such circuits are well known to those skilled in the art and fall within the spirit and scope of the present invention.

In operation, the vent valve 115 is open to permit fluid exit from the rack heat exchanger 54. When the sensor 117 detects the presence of liquid at the top of the rack heat exchanger 54 (at a comestible fluid trigger level or a maximum fill level of the rack heat exchanger), the sensor 117 preferably sends or transmits one or more signals to the system controller 150, which in turn sends or transmits one or more signals to close the vent valve 115 and to prevent fluid from exiting the rack heat exchanger 54. Most preferably, the sensor 117 is selected or positioned so that the vent valve 115 will close just as the rack heat exchanger 54 becomes filled with beer. Depending upon the type of sensor 117 used, the sensor 117 can be positioned in the vent port 113 for detecting the initial entry of beer into the vent port 113, or can even be attached to or immediately beside the vent valve 115. By virtue of the venting arrangements just described, the system controller 150 can vent the space above the level of beer in the rack heat exchanger 54 at any desired time. This not only avoids above-described problems associated with head space, but it also permits easier cleaning. Specifically, when cleaning fluid is flushed through the system, the vent valve 115 and sensor 117 can be operated to ensure that the cleaning fluid contacts, flushes, and cleans all areas of the rack heat exchanger 54.

Many other venting assemblies and elements are well known to those skilled in the art and can be employed in place of the vent port 113, vent valve 115, and sensor 117 described above and illustrated in the figures. These other venting assemblies and elements fall within the spirit and scope of the present invention.

As an alternative to a venting assembly or device to address the problem of rack heat exchanger head space described above, the head space 110 can be filled or plugged with a block of material (not shown) having a shape matching the head space 110. Although many materials such as epoxy, plastic, and aluminum can be used, the block is preferably made of easily cleaned material such as brass, stainless steel, teflon or other food grade synthetic material, and preferably fully occupies all areas of the head space 110.

With combined reference to FIGS. 4 and 6, another important feature of the present invention relates to the maintenance of beer temperature in the nozzle assembly 40. As described above, the rack heat exchanger 54 of the present invention has a number of beer output ports 104 extending therefrom. Each nozzle assembly 40 has an input port 112 to which one of the beer output ports 104 connects in a conventional manner (preferably via conventional fittings). Each output port 104 is preferably made of a highly temperature conductive food grade material such as stainless steel. Most preferably, each input port 112 and the walls of the fluid holding chamber 80 in the nozzle assembly 40 are also made of highly temperature conductive food grade material.

The distance between the body of the rack heat exchanger 54 and the housing 66 of the nozzle assembly 40 is preferably as short as possible while still providing sufficient room for vessel placement and removal to and from the nozzle assembly 40. Preferably, this distance (in the preferred embodiment shown in the figures, the combined lengths of the beer output port 104 and the nozzle assembly input port 112 defining a fluid passage or fluid line between the body of the rack heat exchanger 54 and the nozzle assembly 40) is less than approximately 12 inches (30.5 cm). More preferably, this distance is less than 8 inches (20.3 cm). Most preferably however, this distance is between 1 and 6 inches (2.5–15.2 cm). The nozzle assembly 40 is therefore an extension of the heat exchanger.

The distance between the body of the rack heat exchanger 54 and the housing 66 of the nozzle assembly 40 is important for a particular feature of the present invention: maintaining the temperature of beer in the nozzle assembly 40 as near as possible to the temperature of beer exiting the rack heat exchanger 54. This function is also performed by the preferably thermally conductive material of the beer output port 104 and the nozzle assembly input port 112. Specifically, when beer flows through the nozzle assembly and is dispensed from the dispensing outlet 70, beer has an insufficient time to significantly change from its optimal drinking temperature controlled by the rack heat exchanger 54. When beer is not being dispensed from the nozzle assembly 40, it is most desirable to keep the beer at the optimal drinking temperature.

Prior art beer dispensers are either incapable of keeping beer in the nozzle sufficiently cold for an indefinite length of time or keeping this beer refrigerated in an efficient and inexpensive manner. However, in the present invention, the distance between the refrigerating element (i.e., the rack heat exchanger 54) and the fluid holding chamber 80 in the nozzle assembly 40 is preferably so short that fluid throughout the fluid holding chamber 80 is kept close to the temperature of beer at the rack heat exchanger 54 or exiting the rack heat exchanger 54 by convective recirculation. Specifically, beer in the body of the rack heat exchanger 34 or in the beer output port 104 of the rack heat exchanger 54 is normally the coldest from the rack heat exchanger to the dispensing outlet 70 of the nozzle assembly 40, while beer at the nozzle valve 48 is the warmest because it is farthest from a cold source. A temperature difference or gradient therefore exists between beer in the body of the rack heat exchanger 34 and beer at the terminal end of the nozzle assembly 40. By keeping the rack heat exchanger 34 close to the housing 66 of the nozzle assembly 40 as described above, cooled beer from around and within the beer output port 104 of the rack heat exchanger 34 moves by convection toward the fluid holding chamber 80. Because cold fluid tends to sink, the cold fluid entering the fluid holding chamber migrates to the lowest part of the fluid holding chamber 80—the location of the wannest beer in the nozzle assembly 40. The cold beer thereby mixes with and cools the warm beer. Because warm beer tends to rise, warm beer in the fluid holding chamber 80 rises therein to a location closer to the cold source (the rack heat exchanger 34). This convective recirculation fully effective to maintain beer in the nozzle assembly cold only for the relatively short distances between the rack heat exchanger 34 and the fluid holding chamber 80 described above. Although not required to generate the beer cooling just described, the preferred highly temperature conductive material of the beer output port 104, the nozzle assembly input port 112, and the walls of the fluid holding chamber 80 in the nozzle assembly 40 assist in distributing cold from the rack heat exchanger 34, down the beer output port 104 and nozzle assembly input port 112, and down the fluid holding chamber 80. Cold is therefore preferably distributed downstream of the rack heat exchanger 34 by convective recirculation and by conduction.

In the heat exchanger and nozzle assembly configuration described above and illustrated in the drawings, the rack heat exchanger 34 is capable of maintaining the temperature difference between beer in the rack heat exchanger 34 and beer in the fluid holding chamber to within 5 degrees Fahrenheit. Where exchanger-to-nozzle assembly distances are within the most preferred 1–6 inch (2.5–15.2 cm) range, this temperature difference can be maintained to within 2 degrees Fahrenheit. These temperature differences can be kept indefinitely in the present invention. Although prior art systems exist in which a more distant cold source run at a colder temperature is employed to cool downstream beer, such systems operate with mixed success at the expense of significant energy loss and inefficiency, overcooling beer, and creating large temperature gradients along the fluid path (in some cases even dropping the temperature of elements in the system below freezing)—results that render the preferred system temperature and pressure control of the present invention difficult or impossible.

As an alternative a mounted nozzle assembly such as nozzle assemblies 40 described above and illustrated in FIGS. 1–6, FIGS. 7 and 8 illustrate a portable nozzle assembly 46 in the form of a dispensing gun 16. With the exception of the following description, the dispensing gun 16 employs substantially the same components and connections and operates under substantially the same principles as the rack heat exchanger 34 and nozzle assemblies 40 described above.

The dispensing gun 16 has a gun heat exchanger 44 to which are connected the fluid lines 42 from the kegs 22. Like the rack heat exchanger 34, the gun heat exchanger 44 is preferably a plate heat exchanger having multiple beer input ports 114 and multiple beer output ports 116 corresponding to the different beers supplied to the dispensing gun 16, a refrigerant input port 118 and a refrigerant output port 120. The fluid lines 42 running from the kegs 22 to the dispensing gun 16 are each connected to a beer input port 114, while the refrigerant supply line 52 and the refrigerant return line 56 running between the refrigeration system 48 to the dispensing gun 16 are connected to the refrigerant input port 118 and the refrigerant output port 120, respectively. All of the connections to the gun heat exchanger 44 are conventional in nature and are preferably established by conventional fittings.

Like the rack heat exchanger 34, the gun heat exchanger 44 preferably has multiple fluid paths therethrough that are separate from one another and a refrigerant path that runs along each of the multiple fluid paths to the beers therein. Heat exchangers (and with reference to the illustrated preferred embodiment, plate heat exchangers) having multiple separate fluid compartments and paths are well known to those skilled in the art and are not therefore described further herein.

The gun heat exchanger 44 preferably has a multi-port beer output valve 122 for receiving beer from each of the beer output ports 116. The beer output ports 120 are preferably shaped as shown to run from the body of the gun heat exchanger 44 to the beer output valve 122 to which they are each connected in a conventional manner (such as by conventional fittings, brazing, and the like). Alternatively, the beer output ports 116 can be connected to the beer output valve 122 by relatively short fluid lines (not shown) connected in a conventional manner to the beer output ports 116 and to the beer output valve 122.

The beer output valve 122 is preferably electrically controllable to open one of the beer output ports 116 running from the gun heat exchanger 44 to the beer output valve 122. Many different valve types capable of performing this function are well known to those skilled in the art. In the illustrated preferred embodiment, the beer output valve 122 is a conventional 4-input, 1-output rotary solenoid valve. The beer output valve 122 is preferably electrically connected to a control pad 124 preferably mounted on a face of the gun heat exchanger 44. Alternatively, the beer output valve 122 can be electrically connected to the controls 20 on the vending stand 10 via electrical wires (not shown) running along the fluid and refrigerant lines 42, 52, 56. In the preferred embodiment shown in the figures, the control pad 124 has buttons that can be pressed by a user to operate the beer output valve 122 in a conventional manner.

The nozzle assembly 46 of the dispensing gun 16 is substantially like the nozzle assemblies 40 of the dispensing rack 12 described above and operates in much the same manner. However, the housing 126 preferably has a dispense extension 128 extending from the dispensing outlet 130 thereof. The fluid exit port defined by the opening of the nozzle assembly from which beer exits the nozzle assembly is therefore moved a distance away from the dispensing outlet 130. When the nozzle valve 132 is moved toward and through the dispensing outlet 130 by the actuator 134 to dispense beer, beer flows through the dispensing outlet 130, into the dispense extension 128, and down into the vessel to be filled. The dispense extension 128 is used to help guide beer into the vessel, but is not a required element of the present invention. However, where the dispense extension 128, a trigger sensor 136, and a shutoff sensor 138 are used on the dispensing gun 16 (operated in the same manner as in the dispensing rack nozzle assembly 40 described above), the trigger sensor 136 and the shutoff sensor 138 are preferably mounted on the end of the dispense extension 128 as shown.

As an alternative to electronic or automatic control of the nozzle valve 132, it should be noted that the motion of the nozzle valve 132 can be manually controlled by a user if desired. For example, the user can manipulate a manual control such as a button on the dispensing gun 16 to mechanically open the nozzle valve 132. The nozzle valve can be biased shut by one or more springs, magnets, fluid pressure from the pressurized comestible fluid in the nozzle, etc. in a manner well known to those skilled in the art. By manipulating the manual control, the user preferably moves the nozzle valve 132 through its closed positions to lower pressure in the holding chamber 140, after which the nozzle valve 132 opens to dispense the beer at its lower pressure. As another example, the nozzle valve 132 can be actuated by a user manually as discussed above, after which time an actuator (of the type described earlier) controls how long the nozzle valve 132 remains open. It should also be noted that such manual control over nozzle valve 132 actuation can be applied to the nozzle valves 68 of the rack nozzle assemblies 40 in the same manner as just described for the dispensing gun 16.

In operation, a user grasps the dispensing gun 16 and moves the dispensing gun 16 over a vessel to be filled with beer. Preferably by operating the control pad 124 on the dispensing gun 16, the user changes the type of beer to be dispensed if desired. If the type of beer to be dispensed is changed, a signal is preferably sent from the control pad 124 directly to the beer output valve 122 (or from the control system in response to the control pad 124) to open the beer output port 116 corresponding to the beer selected for dispense. The dispensing gun 16 is then triggered either by user manipulation of a control on the control pad 124 or on the controls 20 of the vending stand, or most preferably by the trigger sensor 136 in the manner described above with regarding to the dispensing rack nozzle assemblies 40. At this time, the empty fluid holding chamber 140 is filled with the selected beer. Immediately thereafter or substantially simultaneous therewith, the nozzle valve 132 is preferably moved toward the dispensing outlet 130 to reduce the pressure in the holding chamber as described above.

Although not preferred, the fluid holding chamber 140 can be fitted with a vent port, valve, and sensor assembly operating the in the same manner as the vent port, valve, and sensor assembly 113, 115, 117 described above with reference to the rack heat exchanger 34. This assembly would preferably be located at the top of the fluid holding chamber 140 for venting the empty fluid holding chamber and to permit faster beer flow into the fluid holding chamber 140 from the beer output valve 122. Such an assembly could be manually controlled, but more preferably is electrically connected to the beer output valve 116, control pad 124, controls 20, or system controller 150 to open with the beer output valve 122 and to close after the fluid holding chamber is full or substantially full.

After the desired amount of beer has been dispensed into the vessel, the valve 132 preferably moves to close the dispensing outlet 130 and the beer output valve preferably moves to a closed position. Most preferably, the beer output valve 122 closes first to permit sufficient time for the fluid holding chamber 140 to empty. In this regard, the vent port, valve, and sensor assembly (not shown) mentioned above can be opened to assist in draining the fluid holding chamber 140. When the valve 132 is returned by the actuator 134 to close the dispensing outlet 130, the nozzle assembly 46 is ready for another dispensing cycle.

In the operation of the dispensing gun 16 as just described, the fluid holding chamber 140 is normally empty between beer dispenses. If such were not the case, beer held therein would be mixed with beer exiting from the beer output valve 122 in the next dispense. While this is not necessarily undesirable if the same beer is being dispensed in the next dispensing cycle, it is undesirable if a different beer is selected for the next dispensing cycle. Although not as desirable as the above-described operation, an alternative dispensing gun operation maintains beer within the fluid holding chamber 140 after each dispense by keeping the beer output valve open while the nozzle valve 132 is open and after the nozzle valve 132 is closed. Such dispensing gun operation is therefore much like the nozzle assembly operation of the dispensing rack nozzle assemblies 40 described above. The beer output valve 122 is preferably controlled by the system controller 150 to remain open through successive dispenses of the same beer. However, if another beer is selected for dispense via the control pad 124 or the vending stand controls 20, the fluid holding chamber 140 is purged of the beer therein before the next dispense. This purging can be performed by the system controller 150 via a user-operable control on the control pad 124 or vending stand controls 20 or automatically by the system controller 150 each time an instruction is received to actuate the beer output valve 122 to open a different beer output port 116. During a purging operation, the beer outlet valve 122 is closed and then the nozzle valve 132 is opened briefly to let the waste beer drain from the fluid holding chamber 140. Immediately thereafter, the actuator 134 preferably moves the nozzle valve 132 back to a closed position and the beer output valve 122 is actuated to open the beer output port 116 corresponding to the beer to be dispensed. Alternatively, the nozzle housing 126 can be provided with a conventional vent port and vent valve (not shown) which are preferably controlled by the system controller 150 to open to drain the beer in the fluid holding chamber 140 prior to opening the beer output valve 122. Whether drained by opening the nozzle valve 132 or by opening a vent valve in the nozzle housing 126, it is also possible to purge the fluid holding chamber 140 under pressure from the new beer selected for dispense by briefly opening the nozzle valve 132 or the vent valve while the beer output valve 122 is open.

Figure 7:
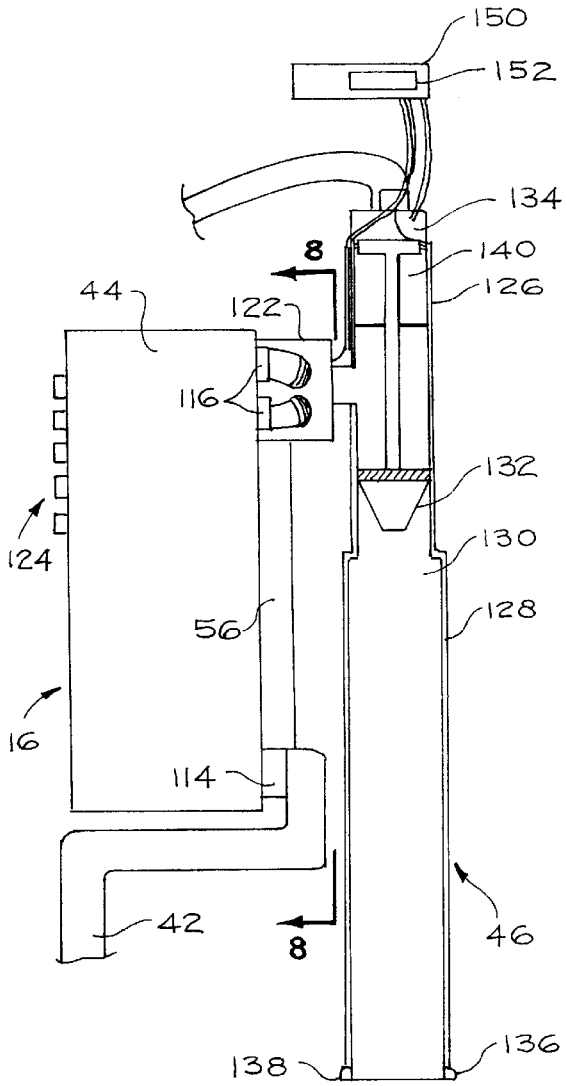
FIG. 7 is a side elevational cross section view of the dispensing gun shown in FIG. 1.
Figure 8:
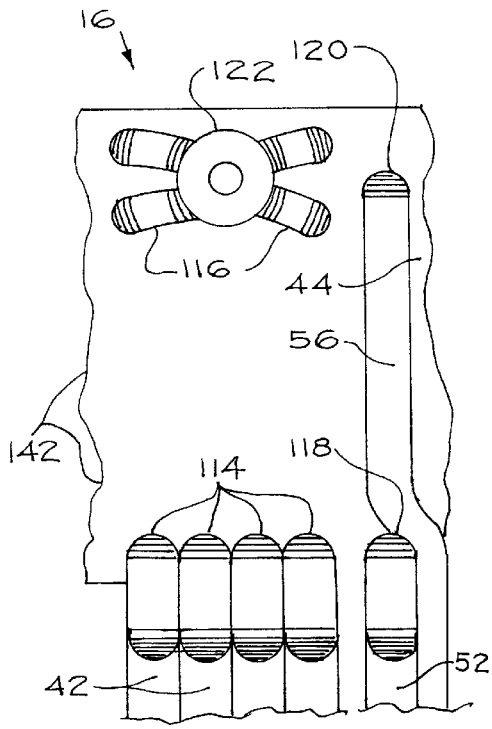
FIG. 8 is front elevational cross section view of the dispensing gun shown in FIG. 7, taken along lines 8—8 of FIG. 7.

In the most highly preferred embodiments of the dispensing gun 16 the beer output valve 122 is located immediately downstream of the heat exchanger as shown in FIGS. 7 and 8. Such a design minimizes the waste of beer from purging the dispensing gun 16 between dispenses of different beer types when the holding chamber 140 is filled with beer between dispenses. However, it is possible (though not preferred) to located the beer output valve 122 in another location between the keg 22 and the nozzle assembly 46. For example, a multi-input port, single output port valve can instead be located upstream of the gun heat exchanger 44. Preferably, all four fluid lines 42 would be connected in a conventional manner to input ports of the valve, which itself would be connected in a conventional manner to a beer input port of the gun heat exchanger 44. The valve would be controllable in substantially the same manner as the beer output valve 122 of the preferred dispensing gun embodiment described above. The advantage provided by this design is that the gun heat exchanger 44 only needs to have one beer fluid path therethrough because only one beer is admitted into the gun heat exchanger 44 at a time. This results in a simpler, less expensive, and easier to clean gun heat exchanger 44. However, the disadvantage of this design is that draining or purging the gun heat exchanger 44 between dispenses of different beers is more difficult. Where draining is not possible to empty the gun heat exchanger 44 and the nozzle assembly 46, the beer can be purged by flowing the newly-selected beer through the dispensing gun 16 or by pushing the beer through the heat exchanger 44 by compressed air or gas (e.g., supplied from the tank 24) via a pneumatic fitting on the gun heat exchanger 44. Although each purge does waste an amount of beer, the combined beer capacity in the gun heat exchanger 44 and the nozzle assembly 46 is relatively small.

The advantages provided by the dispensing gun 16 of the preferred embodiment described above and illustrated in the figures are much the same as those of the of the nozzle assembly 40 and heat exchanger 34 of the dispensing rack 12. For example, the pressure reduction control of beer within the holding chamber 140 of the nozzle assembly 46 prior to opening the dispensing outlet 130 provides fast flow rate with minimal foaming and carbonation loss. As another example, the close proximity of the nozzle assembly 46 to the gun heat exchanger 44 provides the same convective recirculation cooling effect as that of the dispensing rack nozzle assemblies described earlier, thereby keeping beer to a controlled cool temperature up to the dispensing outlet 130. It should be noted that the more compact nature of the dispensing gun 16 (when compared to the nozzle assemblies 40 of the dispensing rack 12) preferably provides for a shorter distance between the body of the gun heat exchanger 44 and the housing 126 of the nozzle assembly 46. This distance is preferably between 1–6 inches (2.5–15.2 cm), but more preferably is between approximately 1–3 inches (2.5–7.6 cm). By virtue of the shorter distances, the maximum temperature difference between the beer in the fluid holding chamber 140 and beer at the gun heat exchanger 44 is less than about 10 degrees Fahrenheit, and more preferably is less than about 5 degrees Fahrenheit. Still shorter heat exchanger-to-nozzle assembly distances are possible to result in narrower temperature differences when the size of the components in the dispensing gun 16 are smaller. Most preferably, the nozzle assembly of the dispensing gun 16 is substantially the same size as the nozzle assembly 40 in the dispensing rack 40. However, if desired, smaller nozzle assemblies and smaller heat exchangers can be used in the dispensing gun 16 at the expense of cooling rate and/or flow rate. It should also be noted that the refrigeration system control and operation discussed above with reference to FIG. 5 applies equally to cooling operations of the gun heat exchanger 44.

The relative orientation of the gun heat exchanger 44 and the nozzle assembly 46 as shown in FIGS. 7 and 8 are not required to practice the present invention. The arrangement illustrated, with the gun heat exchanger 44 alongside the nozzle assembly 46, with hand grip forms 142 on the sides of the gun heat exchanger 44, etc. is presented only as one of many different relative orientations of the gun heat exchanger 44 with respect to the nozzle assembly 46. One having ordinary skill in the art will recognize that many other relative orientations are possible, such as the nozzle assembly 46 being oriented at an angle (e.g., 90 degrees) with respect to its position shown in FIG. 7 and with beer exiting from the beer output valve 122 to the nozzle assembly 46 via an elbow pipe. This and other dispensing gun arrangements fall within the spirit and scope of the present invention.

In addition to these advantages provided by the dispensing gun 16, an equally significant advantage is the fact that the dispensing gun 16 is hand-held and portable. Although dispensing guns are known in the art for dispensing various comestible fluids, their use for many different applications has been very limited. A primary limitation is due to the fact that comestible fluids in prior art dispensing gun lines will become warm after a period of time between dispenses. With no way to cool this comestible fluid before it is dispensed, the vendor must either waste the warmed fluid or attempt to serve it to a customer. In short, dispensing guns for many comestible fluids are not acceptable due to the chance of fluid warming in the lines between dispenses. This is particularly the case for comestible fluids such as beer that are generally not served over ice. The dispensing gun 16 of the present invention addresses this problem by providing a cooling device (the gun heat exchanger 44) at the dispensing gun 16. Therefore, even if comestible fluid becomes warm in the fluid lines 42, the same fluid exits the dispensing gun 16 at a desired and controllable cold temperature. For applications in which a large amount of time can pass between comestible fluid dispenses, the fluid lines 42 are preferably drawn into and stored within a refrigerated storage as described above. The only limitation on use of the dispensing gun 16 to dispense comestible fluids is therefore the spoil rate of the comestible fluid in its storage vessel (keg 22).

The dispensing gun 16 described above and illustrated in the figures is a multiple-beer dispensing gun. It should be noted, however, that the dispensing gun 16 can be adapted to dispense only one beer. Specifically, the beer gun 16 can have one beer input port 114 to which one fluid line 42 running to a keg 22 is coupled in a conventional manner. Such a dispensing gun 16 would therefore preferably have one beer output port 116 running directly to the nozzle assembly 46, and would not therefore need to have the beer output valve 122 and associated wiring employed in the dispensing gun 16 described above. The dispensing gun 16 would operate in substantially the same manner as a heat exchanger 34 and nozzle assembly 40 of the dispensing rack 12, with the exception of only one fluid line, one beer input port, and one beer output port associated with the heat exchanger. Preferably however, the dispensing gun 16 would at least have a manual dispense button (not shown) for manually triggering the actuator 134 to open the dispense outlet 130. The dispensing gun of the preferred illustrated embodiment is capable of selectively dispensing any of four beers supplied thereto. However, following the same principles of the present invention described above, any number of beers can be supplied to a dispensing gun 16 for controlled dispensed therefrom (of course, calling for different numbers of ports and different valve types depending upon the number of beers supplied to the dispensing gun 16). The alternative embodiments of the elements and operation described above with reference to the rack heat exchanger 34 and the nozzle assemblies 40 of the dispensing rack 12 apply equally as alternative embodiments of the dispensing gun 16.

Conversely, the dispensing rack 14 described above can be modified to operate in a manner similar to the multi-fluid input, single output design of the dispensing gun 16. Specifically, rather than have a dedicated nozzle assembly 40 for each beer output port 104 as described above and illustrated in the figures, the dispensing rack 14 can have a beer outlet valve to which the beer outlet ports 104 are connected in a manner similar to the beer outlet valve 122 of the dispensing gun 16. The nozzle assembly 40 would preferably be similar and would operate in a similar manner to the nozzle assembly 46 of the dispensing gun 16 illustrated in FIG. 7. However, the controls for such a system would preferably be located at the vending stand controls 20 rather than on the rack heat exchanger 34. The alternative embodiments of the elements and operation described above with reference to the dispensing gun 16 apply equally as alternative embodiments of the rack heat exchanger 34 and nozzle assembly 40.

Figure 9:
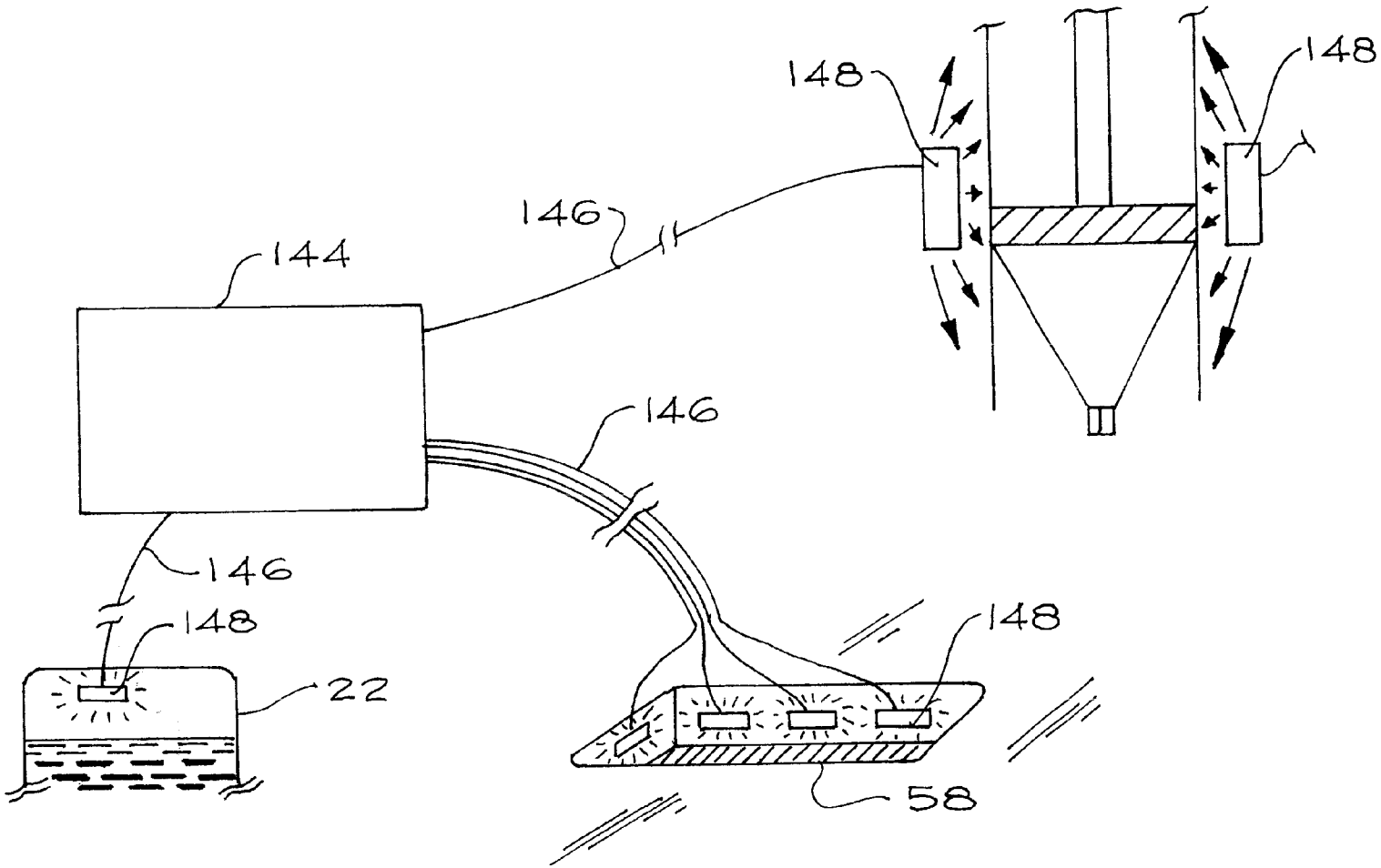
FIG. 9 is a schematic view of a sterilizing system according to a preferred embodiment of the present invention.

As mentioned above, a significant problem in existing comestible fluid dispensers is the difficulty in keeping the fluid dispenser clean. Many comestible fluids (including beer) are particularly susceptible to bacterial and other microbiological growth. Therefore, those areas of the fluid dispensers that come into contact with comestible fluid at any time during dispenser operation should be thoroughly and frequently cleaned. However, even thorough and frequent cleaning is occasionally inadequate to prevent comestible fluid spoilage and contamination. Particularly in those preferred embodiments of the present invention that rely upon sub-surface filling of comestible fluid, it is highly desirable to provide a manner by which surfaces exposed to air are constantly or very frequently sterilized. An apparatus for performing this function is illustrated in FIG. 9. This apparatus relies upon ultraviolet light to sterilize surfaces of the dispensing system in the present invention, and includes an ultraviolet light generator 144 powered in a conventional manner and connected to different areas of the dispensing system. By way of example only, the ultraviolet light generator 144 of FIG. 9 is shown connected to a nozzle assembly 40 in the dispensing rack 12 and to the top of the rack heat exchanger 34.

Conventional ultraviolet light sterilizing devices have been limited in their application due in large part to space requirements of such devices. However, this problem is addressed in the present invention by the use of conventional fiber optic lines 146 transmitting ultraviolet light from the ultraviolet light generator 144 to the surfaces to be sterilized.

Ultraviolet light generators and fiber-optic lines are well known to those skilled in the art, as well as the manner in which fiber-optic lines can be connected to a light source for transmitting light to a location remote from the light source. Accordingly, at least one fiber-optic line 146 is connected in a conventional manner to the ultraviolet light generator 144, and is secured in place in a conventional manner on or adjacent to the surface upon which the ultraviolet light is to be shed. In a preferred embodiment of the present invention, two fiber-optic lines 146 run from the ultraviolet light generator 144 (which can be located within the vending stand 10 or in any other location as desired) to locations beside the housing 66 of the nozzle assembly 40 in the dispensing rack 12. The fiber-optic lines 146 preferably terminate at distribution lenses 148 that distribute ultraviolet light from the fiber-optic lines 146 to the exterior surface of the housing 66. Distribution lenses 148 and their relationship to fiber-optic lines to distribute light emitted from fiber-optic lines is well known to those skilled in the art and is not therefore described further herein. Most preferably, a number of fiber-optic lines 146 run from the ultraviolet light generator 144 to distribution lenses 148 positioned and secured in a conventional about the outer surface of the housing 66. The number of fiber-optic lines 146 and distribution lenses 148 positioned about the housing 66 is determined by the amount of surface desired to be sterilized, but preferably is enough to shed ultraviolet light upon the entire outside surface of the housing 66.

As also shown in FIG. 9, a series of fiber-optic lines 146 preferably run to distribution lenses 148 mounted in a conventional manner within the holder 58 for the dispensing gun 16. Although it is possible to run fiber-optic lines to the dispensing gun 16 itself, more preferably the fiber-optic lines 146 run to the dispensing gun holder 58. Like the distribution lenses 148 about the nozzle assembly 40, the distribution lenses 148 shown on the holder 58 of the dispensing gun 16 receive ultraviolet light from the fiber-optic lines 146 and disperse the ultraviolet light received. In this manner, the fiber-optic lines 146 shed ultraviolet light upon the surfaces of the dispensing gun 16 (and most preferably, the exterior surfaces of the nozzle housing 66).

Fiber-optic lines can be run to numerous other locations in the dispensing system to sterilize surfaces in those locations. As shown in FIG. 9, fiber-optic lines can be run to one or more distribution lenses located at the top of the kegs 22 to sterilize interior surfaces defining head spaces therein. Fiber-optic lines can also or instead run to distribution lenses mounted in locations around the nozzle housing 126 and the dispense extension 128 of the dispensing gun 16, to locations around the dispensing outlets 70, 130 to sterilize the interior ends of the nozzle housings 66, 126, to locations within or at the end of the dispense extension 128 of the dispensing gun 16 to sterilize the interior surfaces thereof, etc. Any place where a head space forms in the dispensing systems of the present invention (and those of the prior art as well) are locations where fiber-optic lines can be run to shed sterilizing ultraviolet light upon head space surfaces.

It should be noted that although distribution lenses 148 are preferred to distribute the ultraviolet light from the fiber-optic lines 146 to a surface to be sterilized, distribution lenses are not required to practice the present invention. Ultraviolet light can instead be transmitted directly from the fiber-optic line 146 to the surface to be sterilized. In such a case, the amount of surface area exposed to the ultraviolet light can be significantly smaller than if a lens 148 is used, but may be particularly desirable for sterilizing surfaces in relatively small spaces. Also, fiber-optic lines 146 represent only one of a number of different ultraviolet light transmitters that can be used in the present invention. For example, the fiber-optic lines 146 can be replaced by light pipes if desired. As is well known to those skilled in the art, light pipes have the ability to receive light and to distribute light radially outwardly along the length thereof. This light distribution pattern is particularly useful in shedding sterilizing ultraviolet light upon a number of surfaces in manners not possible by fiber optic lines. For example, the fiber-optic lines 146 running to the housings 66, 126 of the nozzle assemblies 40, 46 can be replaced by conventional light pipes which are wrapped around the nozzle assemblies 40, 46 or which run alongside the nozzle assemblies 40, 46. Light pipes can be run to any of the locations previously described with reference to the fiber-optic lines, and can even be run through the fluid lines of the system to sterilize inside surfaces thereof, if desired.

The number and locations of the fiber-optic lines 146 and the distribution lenses 148 shown in FIG. 9 are arbitrary and are shown by way of example only. It will be appreciated by one having ordinary skill in the art that any number of fiber-optic lines, distribution lenses, light pipes, or other ultraviolet light transmitting devices can be used in any desired location within or outside of the comestible fluid dispensing apparatus.

To further facilitate easy and thorough cleaning of the present invention, all components of the fluid system are preferably made of a food grade metal such as stainless steel or brass, with the exception of seals, fittings, and valve components made from food grade plastic or other synthetic material as necessary. In highly preferred embodiments of the present invention, the exterior surfaces of the nozzle housings 36, 126 and the dispense extension 128 are teflon-coated to facilitate better cleaning. If desired, other surfaces of the apparatus that are susceptible to bacteria or other microbiological growth can also be teflon-coated, such as the inside surfaces of the nozzle housings 36, 126 and the dispense extension 126, the surfaces of the nozzle valves 68, 132, and the like.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, each of the preferred embodiments of the present invention described above and illustrated in the figures employs a plate heat exchanger 34, 44 to cool the comestible fluid flowing therethrough. A plate heat exchanger is preferred in the application of the present invention due to its relatively high efficiency. However, one having ordinary skill in the art will appreciate that many other types of heat exchangers can be used in place of the preferred plate heat exchangers 34, 44, including without limitation shell and tube heat exchangers, tube in tube heat exchangers, heatpipes, and the like.

Also, each of the embodiments of the present invention described above and illustrated in the figures has one or more kegs 22 stored in a refrigerated vending stand 10. It should be noted, however, that the present invention does not rely upon refrigeration of the source of comestible fluid to dispense cold comestible fluid. Because comestible fluid entering the nozzle assembly 40, 46 has been cooled by the associated heat exchanger 34, 44, the temperature of the comestible fluid upstream of the heat exchangers 34, 44 is relevant only to the amount of work required by the refrigeration system 48 supplying the heat exchangers 34, 44 with cold refrigerant. Therefore, the kegs 22 can be tapped and dispensed from the apparatus of the present invention at room temperature, if desired. Essentially, the present invention replaces the extremely inefficient conventional practice of keeping large volumes of comestible fluid cold for a relatively long period of time prior to dispense with the much more efficient process of quickly cooling comestible fluid immediately prior to dispense using relatively small and efficient heat exchangers 34, 44.

I claim:

1. A comestible fluid dispensing apparatus, comprising:

a comestible fluid pressurizer for pressurizing and maintaining comestible fluid under pressure;

an evaporator in fluid communication with the pressurizer for cooling comestible fluid passed therethrough; and a nozzle having a terminal end, the nozzle attached to the evaporator, the nozzle being located sufficiently close to the evaporator to cool the terminal end of the nozzle without comestible fluid dispense from the nozzle.

2. The apparatus as claimed in claim 1, wherein the comestible fluid pressurizer is a pressurized vessel of comestible fluid in fluid communication with the evaporator.

3. The apparatus as claimed in claim 1, wherein the evaporator is a plate-type heat exchanger.

4. The apparatus as claimed in claim 1, wherein the evaporator is at least one heat pipe.

5. The apparatus as claimed in claim 1, wherein a temperature gradient exists between the evaporator and a terminal end of the nozzle during operation of the apparatus, the temperature gradient enabling convective recirculation of fluid between the evaporator and the terminal end of the nozzle to move warmed comestible fluid from the nozzle toward the evaporator and to move cooled comestible fluid from the evaporator toward the nozzle.

6. The apparatus as claimed in claim 1, wherein a temperature gradient exists between the evaporator and the nozzle during operation of the apparatus, the temperature gradient being maintained by the evaporator below 5 degrees Fahrenheit.

7. The apparatus as claimed in claim 1, wherein a temperature gradient exists between the evaporator and the nozzle during operation of the apparatus, the temperature gradient being maintained by the evaporator below 2 degrees Fahrenheit.

8. The apparatus as claimed in claim 1, wherein the nozzle and the evaporator define a hand-held unit movable to different comestible fluid dispensing locations by a user.

9. The apparatus as claimed in claim 1, wherein the nozzle and the evaporator are attached by a fluid line having a length of less than approximately 12 inches.

10. The apparatus as claimed in claim 1, wherein the nozzle and the evaporator are attached by a fluid line having a length of less than approximately 6 inches.

11. A comestible fluid dispensing apparatus, comprising:

an evaporator for cooling comestible fluid;

a nozzle adjacent to the evaporator;

a fluid line extending from the evaporator through the nozzle for receiving cooled pressurized comestible fluid from the evaporator, the evaporator maintaining comestible fluid in the nozzle below ambient temperature indefinitely regardless of comestible fluid dispense from the nozzle.

12. The apparatus as claimed in claim 11, wherein the nozzle has a comestible fluid reservoir, the fluid line extending from the comestible fluid reservoir and including the comestible fluid reservoir.

13. The apparatus as claimed in claim 11, wherein the evaporator is a plate heat exchanger.

14. The apparatus as claimed in claim 11, wherein the evaporator is at least one heat pipe.

15. The apparatus as claimed in claim 11, wherein a temperature difference exists during operation of the apparatus between comestible fluid in the fluid line at the evaporator and comestible fluid at a terminal end of the nozzle, the temperature difference enabling convective recirculation of warmed comestible fluid toward the evaporator and cooled comestible fluid away from the evaporator.

16. The apparatus as claimed in claim 11, wherein the evaporator has an exit port and wherein a temperature difference exists during operation of the apparatus between comestible fluid at the exit port of the evaporator and comestible fluid in the nozzle, the evaporator capable of maintaining the temperature difference under approximately 5 degrees Fahrenheit indefinitely.

17. The apparatus as claimed in claim 11, wherein the evaporator has an exit port and wherein the a temperature difference exists during operation of the apparatus between comestible fluid at the exit port of the evaporator and comestible fluid in the nozzle, the evaporator capable of maintaining the temperature difference under approximately 2 degrees Fahrenheit indefinitely.

18. The apparatus as claimed in claim 11, wherein the evaporator, nozzle, and fluid line define a hand-held unit separately movable to different dispensing locations by a user.

19. The apparatus as claimed in claim 11, wherein the evaporator and the nozzle are separated by a distance of less than approximately 12 inches.

20. The apparatus as claimed in claim 11, wherein the evaporator and the nozzle are separated by a distance of less than approximately 6 inches.

21. A comestible fluid dispensing apparatus, comprising:

an evaporator;

a fluid nozzle coupled to the evaporator, the fluid nozzle having a dispensing outlet;

a fluid passage establishing fluid communication between the evaporator and the dispensing outlet of the fluid nozzle, the fluid passage being sufficiently short to permit convective recirculation of comestible fluid therein between the evaporator and the dispensing outlet of the fluid nozzle.

22. The apparatus as claimed in claim 21, wherein the evaporator is a plate heat exchanger.

23. The apparatus as claimed in claim 21, wherein the evaporator is at least one heat pipe.

24. The apparatus as claimed in claim 21, wherein temperatures of comestible fluid along the fluid passage during operation of the apparatus are maintained by the evaporator to within 5 degrees Fahrenheit indefinitely.

25. The apparatus as claimed in claim 21, wherein temperatures of comestible fluid along the fluid passage during operation of the apparatus are maintained by the evaporator to within 2 degrees Fahrenheit indefinitely.

26. The apparatus as claimed in claim 21, wherein the evaporator, fluid nozzle, and fluid passage are hand-portable to different dispensing locations by a user.

27. A comestible fluid nozzle assembly, comprising:

a fluid nozzle having an interior cavity therein;

a fluid line defined at least in part by the interior cavity of the fluid nozzle, the fluid line having at least one wall within which a comestible fluid can be retained;

a heat exchanger coupled to the fluid line, the heat exchanger being sufficiently close to the fluid nozzle to cool fluid in the fluid nozzle via convective recirculation.

28. The nozzle assembly as claimed in claim 27, wherein the heat exchanger is a plate-type heat exchanger.

29. The nozzle assembly as claimed in claim 27, wherein the heat exchanger is at least one heat pipe.

30. The nozzle assembly as claimed in claim 27, wherein the fluid line is sufficiently short to permit cooled comestible fluid to move under convective recirculation from the heat exchanger to the interior cavity of the nozzle and to permit warmed comestible fluid to move under convective recirculation from the interior cavity of the nozzle to the heat exchanger.

31. The nozzle assembly as claimed in claim 30, wherein temperature differences across the fluid line during operation are maintained by the heat exchanger to within approximately 5 degrees Fahrenheit.

32. The nozzle assembly as claimed in claim 30, wherein temperature differences across the fluid line during operation are maintained by the heat exchanger to within approximately 2 degrees Fahrenheit.

33. The nozzle assembly as claimed in claim 27, wherein the nozzle assembly is a hand-held device movable by a user to different comestible fluid dispensing locations.

34. The nozzle assembly as claimed in claim 27, wherein the fluid nozzle and the heat exchanger are less than approximately 12 inches apart.

35. The nozzle assembly as claimed in claim 27, wherein the fluid nozzle and the heat exchanger are less than approximately 6 inches apart.

* * * * *